US011557254B2

(12) United States Patent
Kim et al.

(10) Patent No.: US 11,557,254 B2
(45) Date of Patent: Jan. 17, 2023

(54) PIXEL OF AN ORGANIC LIGHT EMITTING DIODE DISPLAY DEVICE, AND ORGANIC LIGHT EMITTING DIODE DISPLAY DEVICE

(71) Applicant: Samsung Display Co., Ltd., Yongin-Si (KR)

(72) Inventors: Na-Young Kim, Seongnam-si (KR); Dong-Hwi Kim, Osan-si (KR); Chul Ho Kim, Cheonan-si (KR); Yun Hwan Park, Seoul (KR); Jin Jeon, Seoul (KR); Hyun Wook Choi, Seongnam-si (KR)

(73) Assignee: Samsung Display Co., Ltd.

( * ) Notice: Subject to any disclaimer, the term of this patent is extended or adjusted under 35 U.S.C. 154(b) by 48 days.

(21) Appl. No.: 16/984,010

(22) Filed: Aug. 3, 2020

(65) Prior Publication Data

US 2021/0142733 A1 May 13, 2021

(30) Foreign Application Priority Data

Nov. 11, 2019 (KR) ..... 10-2019-0143696

(51) Int. Cl.
*G09G 3/3208* (2016.01)
*G09G 3/3266* (2016.01)

(52) U.S. Cl.
CPC ... *G09G 3/3266* (2013.01); *G09G 2300/0842* (2013.01); *G09G 2310/066* (2013.01); *G09G 2320/0653* (2013.01); *G09G 2330/028* (2013.01)

(58) Field of Classification Search
CPC ..... G09G 3/3266; G09G 2300/0842; G09G 2310/066; G09G 2320/0653; G09G 2330/028
See application file for complete search history.

(56) References Cited

U.S. PATENT DOCUMENTS

2015/0348464 A1* 12/2015 In ..... G09G 3/2022 345/82
2018/0006099 A1* 1/2018 Ka ..... H01L 27/3262
2019/0130832 A1* 5/2019 Chang ..... G09G 3/3266
2020/0312216 A1* 10/2020 Kim ..... G09G 3/2011

FOREIGN PATENT DOCUMENTS

JP 2017-097208 A 6/2017
KR 10-0822205 B1 4/2008
KR 10-0926591 B1 11/2009
KR 10-2018-0114981 A 10/2018

* cited by examiner

*Primary Examiner* — Wing H Chow
(74) *Attorney, Agent, or Firm* — Innovation Counsel LLP

(57) ABSTRACT

A pixel of an OLED display device includes a capacitor coupled between first and second nodes, first and second transistors, each including a gate receiving a respective initialization signal, a first terminal receiving a first power supply voltage, and a second terminal coupled to the capacitor, a third transistor including a first terminal coupled to a data line and a second terminal coupled to the first node, a fourth transistor including a gate coupled to the second node, a first terminal receiving the first power supply voltage, and a second terminal coupled to a third node, a fifth transistor including a first terminal coupled to the third node and a second terminal coupled to the second node, sixth and seventh transistors receiving a scan signal, eighth and ninth transistors receiving an emission signal, and an OLED.

20 Claims, 18 Drawing Sheets

@PINIT

NORMAL FREQUENCY DRIVING
(DRIVING FREQUENCY = 120Hz or 60Hz)

@PINIT

LOW FREQUENCY DRIVING
(DRIVING FREQUENCY = 1Hz)

PIXEL OF AN ORGANIC LIGHT EMITTING DIODE DISPLAY DEVICE, AND ORGANIC LIGHT EMITTING DIODE DISPLAY DEVICE

CROSS-REFERENCE TO RELATED APPLICATION(S)

This application claims priority under 35 USC § 119 to Korean Patent Application No. 10-2019-0143696, filed on Nov. 11, 2019 in the Korean Intellectual Property Office (KIPO), the disclosure of which is incorporated herein by reference in its entirety.

BACKGROUND

1. Field

The present disclosure relates generally to a display device, and more particularly to a pixel of an organic light emitting diode (OLED) display device, and the OLED display device including the pixel.

2. Description of the Related Art

Reduction of power consumption in an OLED display device is highly desirable particularly when the OLED device is employed in a portable device such as a smartphone, a tablet computer, etc. Recently, in order to reduce the power consumption of the OLED display device, a low frequency driving technique has been developed. The low frequency driving technique drives or refreshes a display panel of the OLED display device at a frequency lower than a normal frequency (e.g., an input frame frequency) at which the display panel is driven.

When the display panel of the OLED display device is driven at a low frequency, a gate-source voltage having a high absolute value may be applied as a bias voltage to a driving transistor of each pixel in a portion of a plurality of frame periods (e.g., in the first frame period among 60 or 120 frame periods), but the bias voltage may not be applied to the driving transistor in the remaining frame periods (e.g., in the subsequent 59 frame periods among the 60 frame periods or in the subsequent 119 frame periods among the 120 frame periods). In this case, a threshold voltage of the driving transistor may be shifted in a negative direction (i.e., a negative shift of the threshold voltage may occur) in the portion of the plurality of frame periods (e.g., the first frame period) in which the gate-source voltage having the high absolute value is applied, and the threshold voltage may be gradually shifted in a positive direction in the subsequent frame periods. Accordingly, the gradual positive shift of the threshold voltage may gradually increase luminance of the OLED display device at the low frequency driving.

SUMMARY

Some example embodiments provide a pixel of an organic light emitting diode (OLED) display device capable of preventing a gradual increase of luminance at low frequency driving.

Some example embodiments provide an OLED display device capable of preventing a gradual increase of luminance at low frequency driving.

According to an example embodiment, a pixel of an OLED display device includes a capacitor including a first electrode coupled to a first node, and a second electrode coupled to a second node, a first transistor including a gate receiving a first initialization signal, a first terminal receiving a first power supply voltage, and a second terminal coupled to the first node, a second transistor including a gate receiving a second initialization signal, a first terminal receiving the first power supply voltage, and a second terminal coupled to the second node, a third transistor including a first terminal coupled to a data line and a second terminal coupled to the first node, a fourth transistor including a gate coupled to the second node, a first terminal receiving the first power supply voltage, and a second terminal coupled to a third node, a fifth transistor including a first terminal coupled to the third node and a second terminal coupled to the second node, a sixth transistor including a gate receiving a scan signal, a first terminal receiving an initialization voltage, and a second terminal coupled to a fourth node, a seventh transistor including a gate receiving the scan signal, a first terminal receiving the initialization voltage, and a second terminal coupled to the first node, an eighth transistor including a gate receiving an emission signal, a first terminal receiving a reference voltage, and a second terminal coupled to the first node, a ninth transistor including a first terminal coupled to the third node and a second terminal coupled to the fourth node, and an OLED including an anode coupled to the fourth node, and a cathode receiving a second power supply voltage.

The pixel may include at least one P-type metal-oxide-semiconductor (PMOS) transistor, and at least one N-type metal-oxide-semiconductor (NMOS) transistor.

The first, third, fourth, sixth, seventh, eighth and ninth transistors may be PMOS transistors, and the second and fifth transistors may be NMOS transistors.

The OLED display device may be operable to perform normal frequency driving by driving the pixel at a normal frequency, and each frame period of the OLED display device at the normal frequency driving may include an initialization period in which the capacitor is initialized, a threshold voltage compensation period in which a data voltage is provided to the first electrode of the capacitor through the data line, and a threshold voltage of the fourth transistor is compensated, a bias period in which a bias voltage is applied to the fourth transistor, and the OLED is initialized, and an emission period in which the OLED emits light.

In the initialization period, the first transistor may apply the first power supply voltage to the first node in response to the first initialization signal having a first level, and the second transistor may apply the first power supply voltage to the second node in response to the second initialization signal having a second level that has an opposite polarity of the first initialization signal.

In the initialization period, the capacitor may be initialized based on the first power supply voltage at the first node and the second node, and the first power supply voltage may be applied to the first terminal of the fourth transistor and the gate of the fourth transistor.

In the threshold voltage compensation period, the third transistor may apply the data voltage provided through the data line to the first node in response to a first writing signal having a first level that is applied to a gate of the third transistor, and the fifth transistor may diode-connect the fourth transistor in response to a second writing signal having a second level that is applied to a gate of the fifth transistor, and wherein the second writing signal has an opposite polarity of the first writing signal.

In the threshold voltage compensation period, the data voltage may be stored at the first electrode of the capacitor, and the first power supply voltage subtracted with the threshold voltage of the fourth transistor may be stored at the second electrode of the capacitor.

In the bias period, the sixth transistor may apply the initialization voltage to the fourth node in response to the scan signal having a first level, and the seventh transistor may apply the initialization voltage to the first node in response to the scan signal having the first level.

In the bias period, the OLED may be initialized based on the initialization voltage at the fourth node, a voltage of the first electrode of the capacitor may be changed from the data voltage to the initialization voltage, and a voltage of the second electrode of the capacitor may be changed, by coupling with the first electrode of the capacitor, to the first power supply voltage minus the threshold voltage of the fourth transistor plus the initialization voltage minus the data voltage.

In the emission period, the eighth transistor may apply the reference voltage to the first node in response to the emission signal having a first level, the fourth transistor may generate a driving current based on a voltage of the second electrode of the capacitor, the ninth transistor may couple the third node to the fourth node in response to the emission signal having the first level that is applied to a gate of the ninth transistor, and the OLED may emit light based on the driving current.

In the emission period, a voltage of the first electrode of the capacitor may be changed from the initialization voltage to the reference voltage, and the voltage of the second electrode of the capacitor may be changed, by coupling with the first electrode of the capacitor, to the first power supply voltage minus the threshold voltage of the fourth transistor minus the data voltage plus the reference voltage.

The OLED display device may be operable to perform low frequency driving by driving the pixel at a low frequency that is lower than a normal frequency, and at least one of a plurality of frame periods of the OLED display device at the low frequency driving may include an initialization period in which the capacitor is initialized, a threshold voltage compensation period in which a data voltage is provided to the first electrode of the capacitor through the data line, and a threshold voltage of the fourth transistor is compensated, a bias period in which a bias voltage is applied to the fourth transistor and the OLED is initialized, and an emission period in which the OLED emits light, and each of remaining frame periods of the plurality of frame periods may include only the bias period and the emission period.

While the OLED display device performs the low frequency driving, the first initialization signal and the second initialization signal may be provided to the pixel at the low frequency of the low frequency driving, and the scan signal and the emission signal may be provided to the pixel at the normal frequency.

The second transistor may further include a first bottom electrode under the gate of the second transistor, and the fifth transistor may further include a second bottom electrode under the gate of the fifth transistor.

The first bottom electrode of the second transistor may receive the second initialization signal, and the second bottom electrode of the fifth transistor may receive a second writing signal that is applied to a gate of the fifth transistor.

The first bottom electrode of the second transistor may be coupled to the first terminal of the second transistor, and the second bottom electrode of the fifth transistor may be coupled to the second terminal of the fifth transistor.

According to an example embodiment, a pixel of an OLED display device includes a capacitor including a first electrode coupled to a first node, and a second electrode coupled to a second node, a first transistor including a gate receiving a first initialization signal, a first terminal receiving a first power supply voltage, and a second terminal coupled to the first node, a second transistor including a gate receiving a second initialization signal, a first terminal receiving the first power supply voltage, and a second terminal coupled to the second node, a driving transistor including a gate coupled to the second node, an emission transistor including a gate receiving an emission signal, a first terminal receiving the initialization voltage, and a second terminal coupled to the first node, a ninth transistor including a gate receiving the emission signal, a first terminal coupled to the third node, and a second terminal coupled to the fourth node, and an OLED coupled to the emission transistor and including a cathode receiving a second power supply voltage.

The OLED display device may be operable to perform low frequency driving by driving the pixel at a low frequency that is lower than a normal frequency, and at least one of a plurality of frame periods of the OLED display device at the low frequency driving may include an initialization period in which the capacitor is initialized, a threshold voltage compensation period in which a data voltage is provided to the first electrode of the capacitor through the data line, a threshold voltage of the driving transistor is compensated, and the OLED is initialized, and an emission period in which the OLED emits light in response to the emission signal, and each of remaining frame periods of the plurality of frame periods may include only the emission period.

According to an example embodiment, an OLED display device includes a plurality of pixels, and each of the plurality of pixels includes a capacitor including a first electrode coupled to a first node, and a second electrode coupled to a second node, a first transistor including a gate receiving a first initialization signal, a first terminal receiving a first power supply voltage, and a second terminal coupled to the first node, a second transistor including a gate receiving a second initialization signal, a first terminal receiving the first power supply voltage, and a second terminal coupled to the second node, a driving transistor including a gate coupled to the second node, an emission transistor including a gate receiving an emission signal, and an OLED coupled to the emission transistor and including a cathode receiving a second power supply voltage.

As described above, each pixel of an OLED display device may include at least one PMOS transistor, and at least one NMOS transistor. Accordingly, a leakage current in the pixel may be reduced, and thus the pixel may be suitable for low frequency driving.

Further, in each pixel of an OLED display device according to an example embodiment, a voltage for initializing a capacitor and a voltage for initializing an OLED may be different from each other, and a gate-source voltage having a low absolute value may be applied to a driving transistor when the capacitor is initialized. Accordingly, a gradual increase of luminance at low frequency driving may be prevented.

BRIEF DESCRIPTION OF THE DRAWINGS

Illustrative, non-limiting example embodiments of the present inventive concept will be more clearly understood from the following detailed description in conjunction with the accompanying drawings.

DETAILED DESCRIPTION OF THE EMBODIMENTS

Hereinafter, embodiments of the present inventive concept will be explained in detail with reference to the accompanying drawings.

Figure 1:
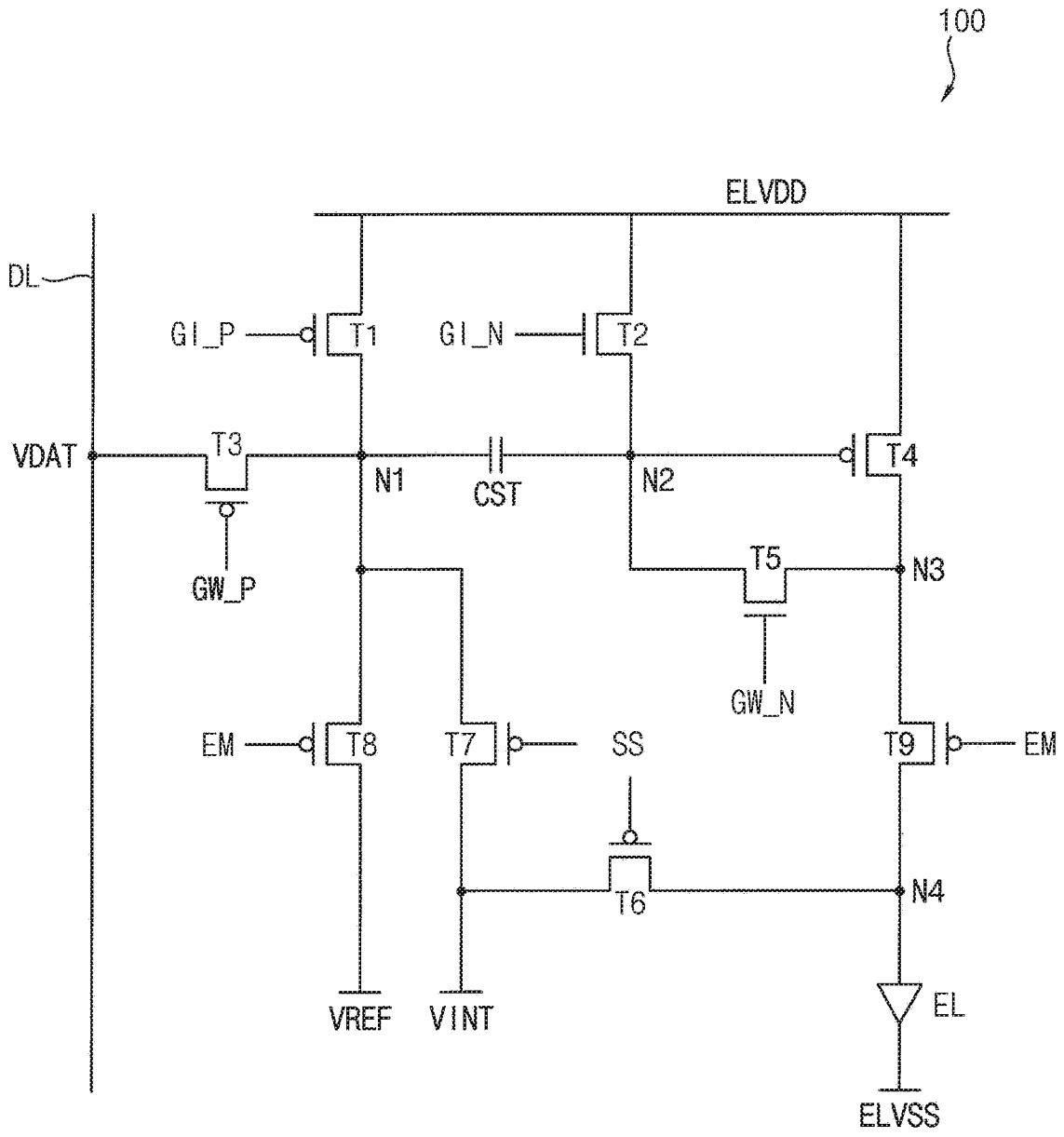
FIG. 1 is a circuit diagram illustrating a pixel of an organic light emitting diode (OLED) display device according to an example embodiment.

FIG. 1 is a circuit diagram illustrating a pixel of an organic light emitting diode (OLED) display device according to an example embodiment.

Referring to FIG. 1, a pixel 100 of an OLED display device may include a capacitor CST, first through ninth transistors T1, T2, T3, T4, T5, T6, T7, T8, and T9, and an organic light emitting diode (OLED) EL.

The capacitor CST may store a data voltage VDAT provided through a data line DL. In some example embodiments, the capacitor CST may be referred to as a storage capacitor. For example, as illustrated in FIG. 1, the capacitor CST may include a first electrode coupled to a first node N1, and a second electrode coupled to a second node N2.

The first transistor T1 may transfer a first power supply voltage ELVDD to the first node N1 in response to a first initialization signal GI_P, and the second transistor T2 may transfer the first power supply voltage ELVDD to the second node N2 in response to a second initialization signal GI_N. In some example embodiments, the first and second transistors T1 and T2 may be referred to as capacitor initializing transistors. For example, as illustrated in FIG. 1, the first transistor T1 may include a gate receiving the first initialization signal GI_P, a first terminal receiving the first power supply voltage ELVDD, and a second terminal coupled to the first node N1, and the second transistor T2 may include a gate receiving the second initialization signal GI_N, a first terminal receiving the first power supply voltage ELVDD, and a second terminal coupled to the second node N2.

The third transistor T3 may transfer the data voltage VDAT to the first node N1 in response to a first writing signal GW_P. In some example embodiments, the third transistor T3 may be referred to as a data writing transistor. For example, as illustrated in FIG. 1, the third transistor T3 may include a gate receiving the first writing signal GW_P, a first terminal coupled to the data line DL, and a second terminal coupled to the first node N1.

The fourth transistor T4 may generate a driving current based on a voltage of the second node N2, or a voltage of the second electrode of the capacitor CST. In some example embodiments, the fourth transistor T4 may be referred to as a driving transistor. For example, as illustrated in FIG. 1, the fourth transistor T4 may include a gate coupled to the second node N2, a first terminal receiving the first power supply voltage ELVDD, and a second terminal coupled to a third node N3.

The fifth transistor T5 may diode-connect the fourth transistor T4 in response to a second writing signal GW_N. In some example embodiments, the fifth transistor T5 may be referred to as a compensating transistor. For example, as illustrated in FIG. 1, the fifth transistor T5 may include a gate receiving the second writing signal GW_N, a first terminal coupled to the third node N3, and a second terminal coupled to the second node N2.

The sixth transistor T6 may transfer an initialization voltage VINT to an anode of the OLED EL in response to a scan signal SS. In some example embodiments, the sixth transistor T6 may be referred to as an anode initializing transistor. For example, as illustrated in FIG. 1, the sixth transistor T6 may include a gate receiving the scan signal SS, a first terminal receiving the initialization voltage VINT, and a second terminal coupled to a fourth node N4.

The seventh transistor T7 may transfer the initialization voltage VINT to the first node N1 in response to the scan signal SS. In some example embodiments, the seventh transistor T7 may be referred to as a bias transistor. For example, as illustrated in FIG. 1, the seventh transistor T7 may include a gate receiving the scan signal SS, a first terminal receiving the initialization voltage VINT, and a second terminal coupled to the first node N1.

The eighth transistor T8 may transfer a reference voltage VREF to the first node N1 in response to an emission signal EM, and the ninth transistor T9 may couple the third node N3 to the fourth node N4 in response to the emission signal EM. In some example embodiments, the eighth and ninth transistors T8 and T9 may be referred to as emission transistors. For example, as illustrated in FIG. 1, the eighth transistor T8 may include a gate receiving the emission signal EM, a first terminal receiving the reference voltage VREF, and a second terminal coupled to the first node N1, and the ninth transistor T9 may include a gate receiving the emission signal EM, a first terminal coupled to the third node N3, and a second terminal coupled to the fourth node N4.

The OLED EL may emit light based on the driving current generated by the fourth transistor T4. For example, as illustrated in FIG. 1, the OLED EL may include the anode coupled to the fourth node N4, and a cathode receiving a second power supply voltage ELVSS.

In some example embodiments, at least one of the first through ninth transistors T1 through T9 may be implemented with a low-temperature polycrystalline silicon (LTPS) P-type metal-oxide-semiconductor (PMOS) transistor, and at least another one of the first through ninth transistors T1 through T9 may be implemented with an oxide N-type metal-oxide-semiconductor (NMOS) transistor. For example, as illustrated in FIG. 1, the first, third, fourth, sixth, seventh, eighth, and ninth transistors T1, T3, T4, T6, T7, T8 and T9 may be PMOS transistors, and the second and fifth transistors T2 and T5 may be NMOS transistors. Further, the first initialization signal GI_P, the first writing signal GW_P, the scan signal SS, and the emission signal EM applied to the first, third, sixth, seventh, eighth, and ninth transistors T1, T3, T6, T7, T8, and T9 may be active low signals having a low level as an active level, and the second initialization signal GI_N and the second writing signal GW_N applied to the second and fifth transistors T2 and T5 may be active high signals having a high level as the active level. In this case, since the second and fifth transistors T2 and T5 that are directly connected to the second node N2 (or the second electrode of the capacitor CST) are implemented with the NMOS transistors, a leakage current from the second electrode of the capacitor CST may be reduced. Accordingly, when the pixel 100 is driven at a low frequency lower than a normal frequency (e.g., about 60 Hz or about 120 Hz), a voltage of the second electrode of the capacitor CST may not very substantially, and thus the pixel 100 may be suitable for low frequency driving.

As a comparative example of a conventional OLED display device that performs the low frequency driving, a gate-source voltage having a high absolute value may be applied as a bias voltage to a driving transistor of each pixel in a portion of a plurality of frame periods (e.g., in the first frame period among 60 or 120 frame periods), and the bias voltage may not be applied to the driving transistor in the remaining frame periods (e.g., in the subsequent 59 or 119 frame periods among the 60 or 120 frame periods). In this case, a threshold voltage of the driving transistor may be shifted in a negative direction (i.e., a negative shift of the threshold voltage may occur) in the first frame period, and the threshold voltage may be gradually shifted in a positive direction in the subsequent frame periods. Accordingly, due to the gradual positive shift of the threshold voltage, luminance of the conventional OLED display device may be gradually increased at the low frequency driving. However, in the pixel 100 according to an example embodiment, a voltage (i.e., the first power supply voltage ELVDD) for initializing the capacitor CST and a voltage (i.e., the initialization voltage VINT) for initializing the OLED EL may be different from each other, and a gate-source voltage having a low absolute value (e.g., in case of the pixel 100 of FIG. 1, about 0V) may be applied to the driving transistor, or the fourth transistor T4, when the capacitor CST is initialized. Accordingly, in the pixel 100 according to an example embodiment, the gradual increase of luminance at low frequency driving may be prevented.

Hereinafter, an example of operating the pixel 100 of FIG. 1 at normal frequency driving will be described below with reference to FIGS. 2 through 6.

Figure 2:
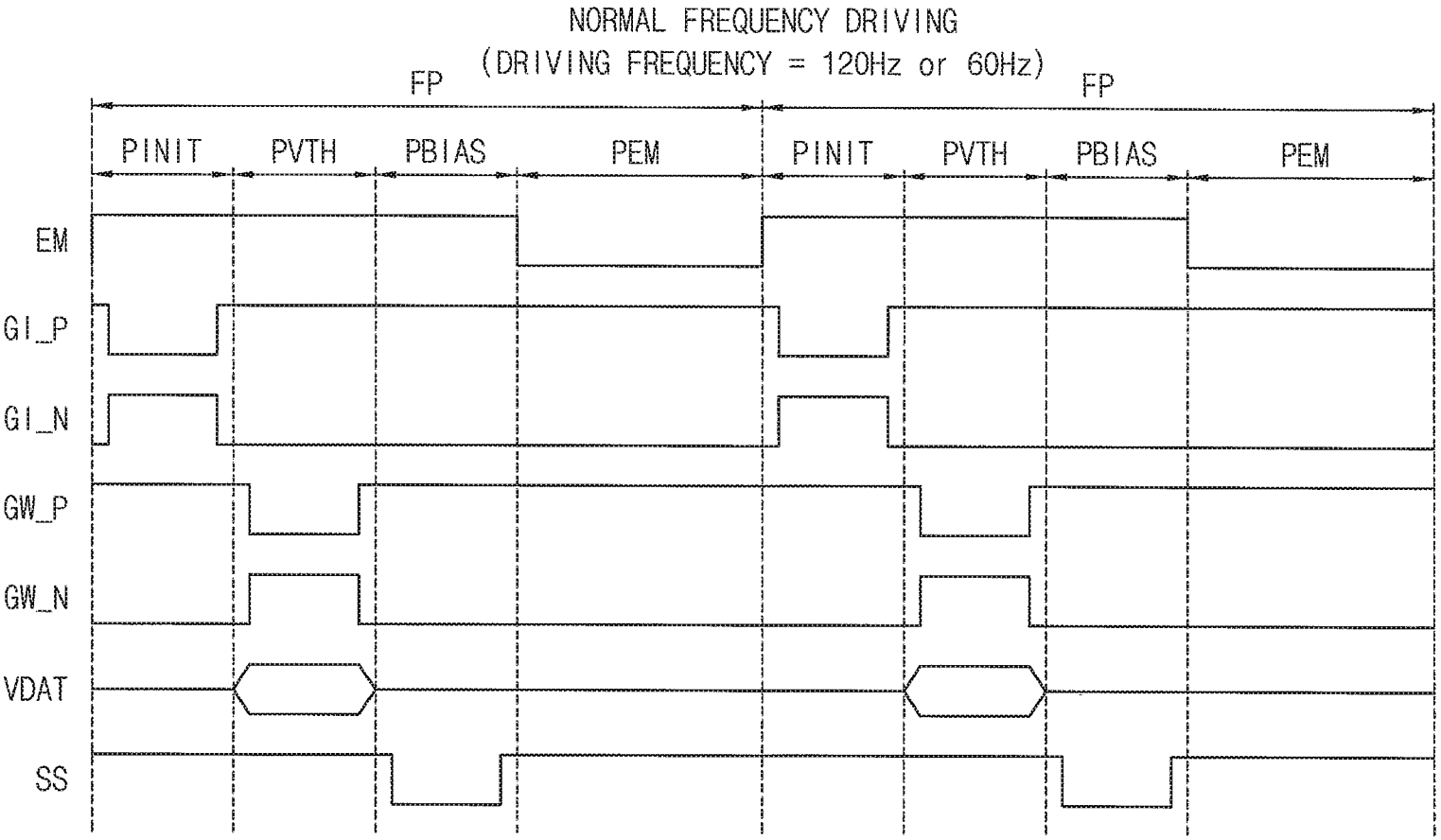
FIG. 2 is a timing diagram for an example operation of a pixel of FIG. 1 at normal frequency driving.
Figure 3:
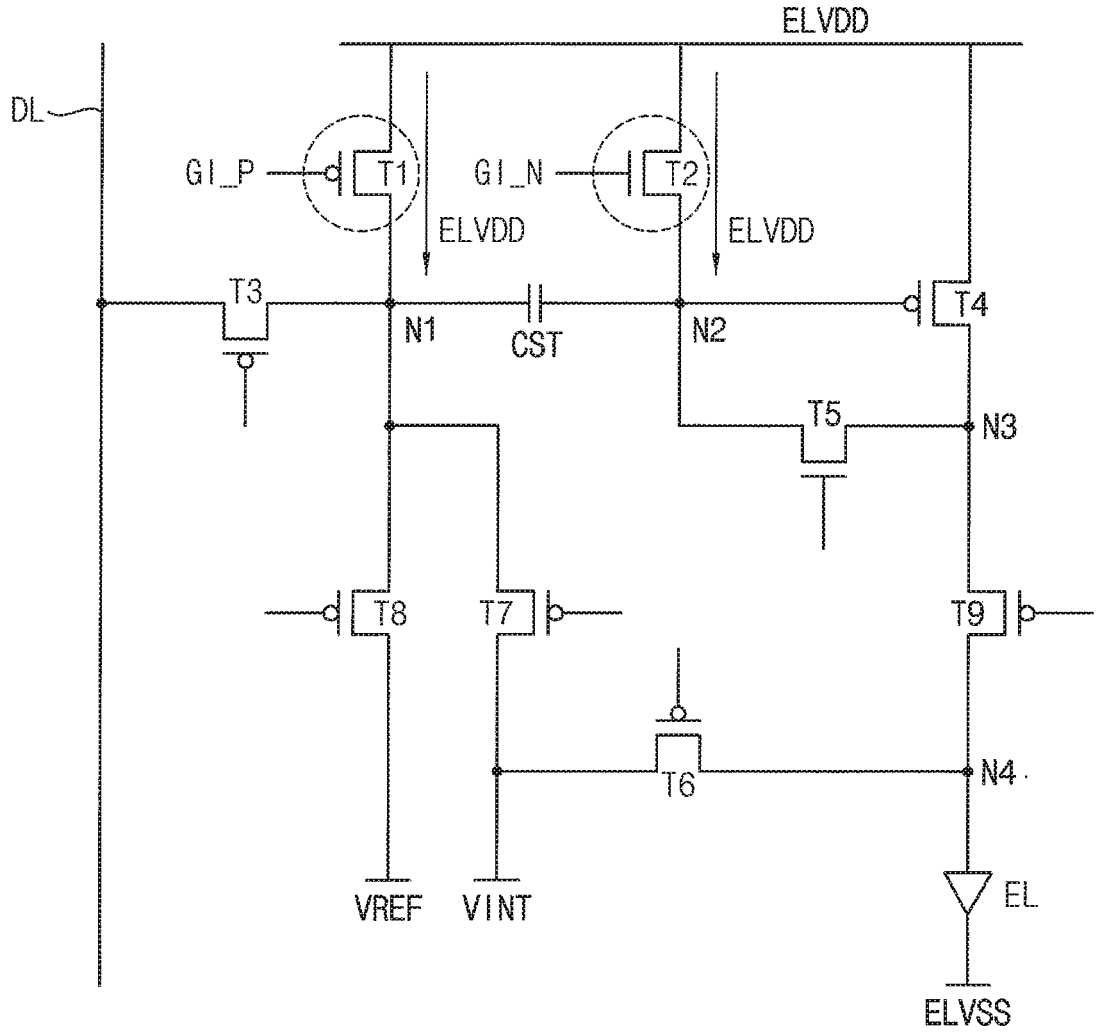
FIG. 3 is a circuit diagram for an example operation of a pixel of FIG. 1 in an initialization period.
Figure 4:
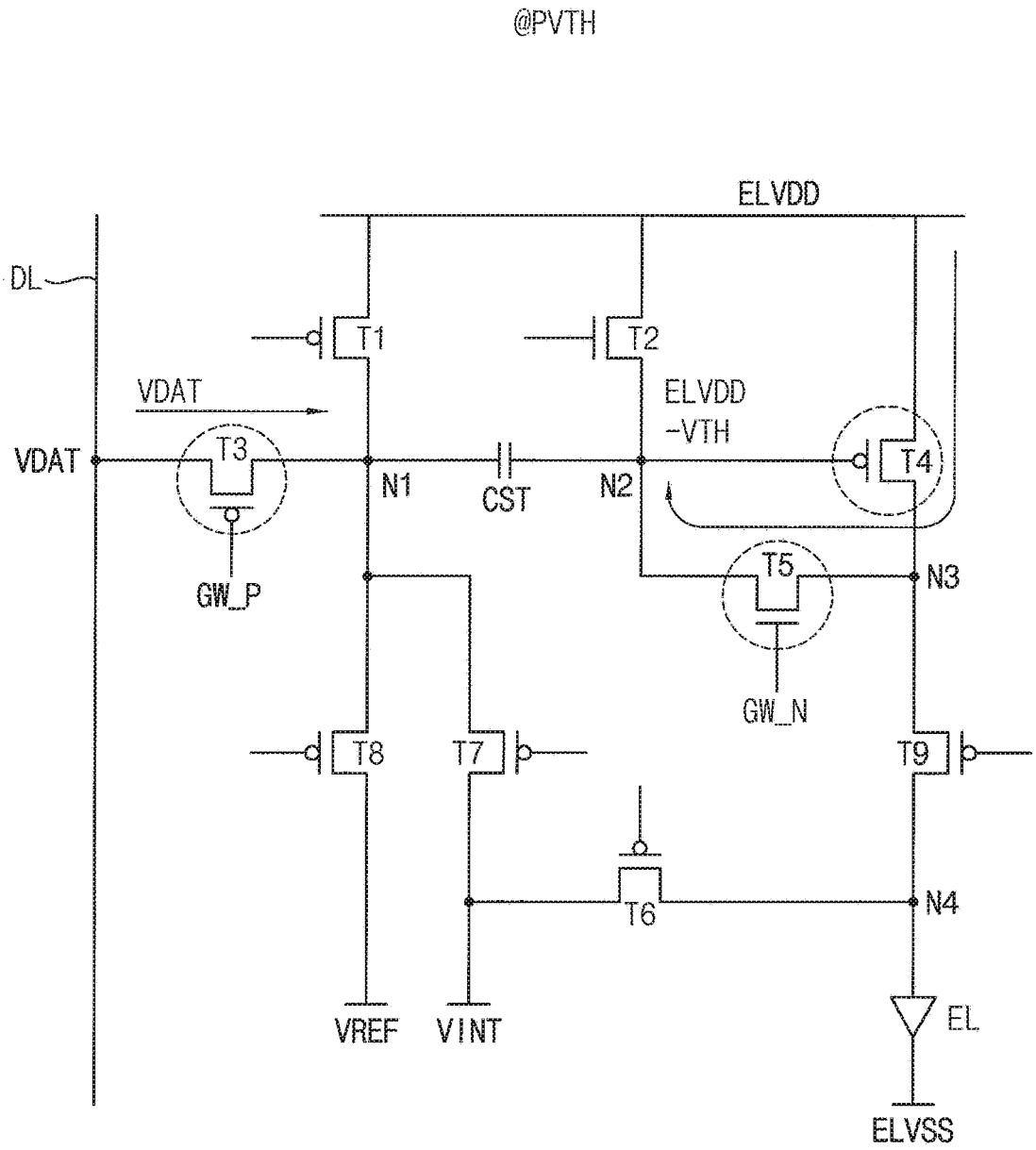
FIG. 4 is a circuit diagram for an example operation of a pixel of FIG. 1 in a threshold voltage compensation period.
Figure 5:
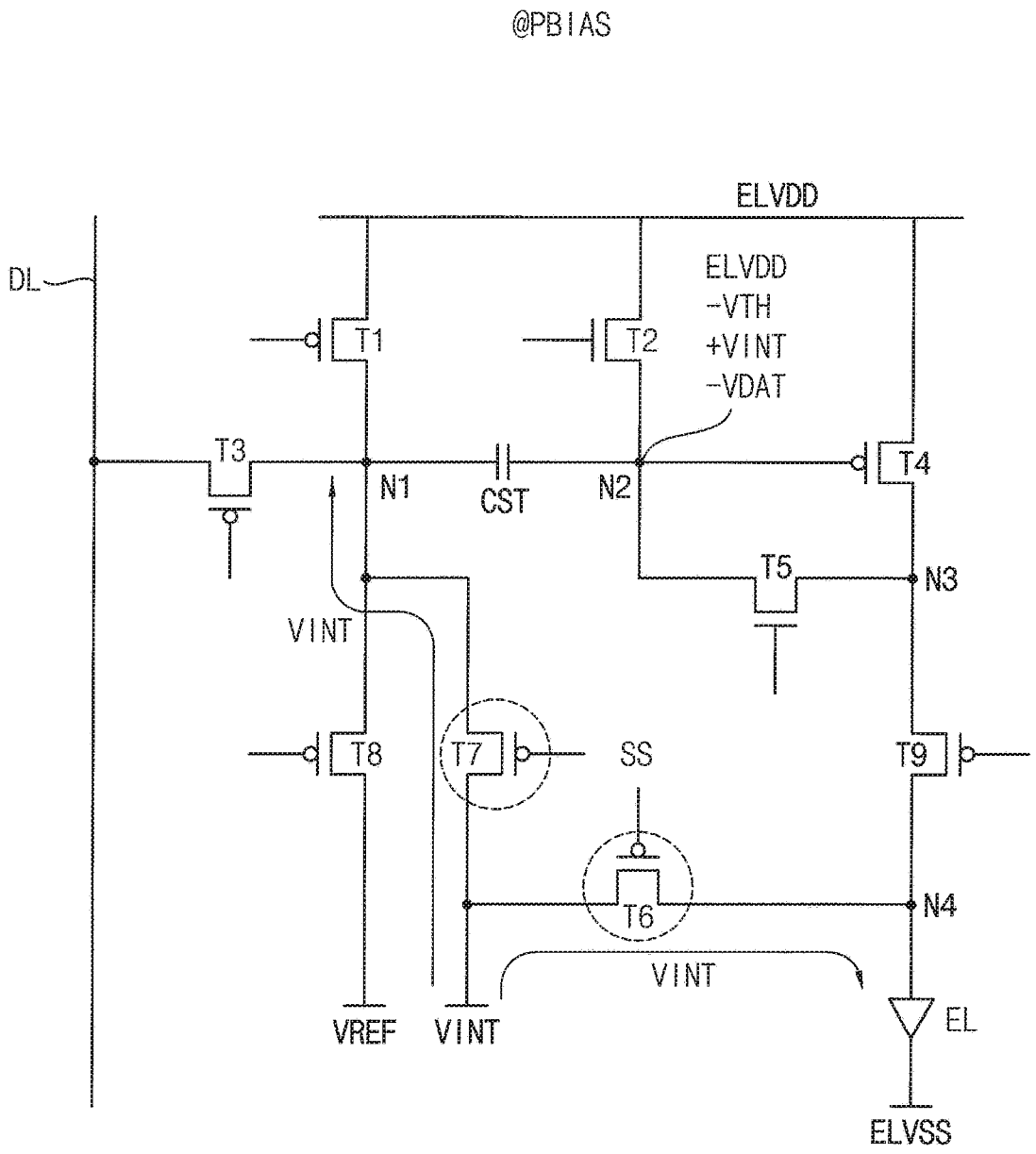
FIG. 5 is a circuit diagram for an example operation of a pixel of FIG. 1 in a bias period.
Figure 6:
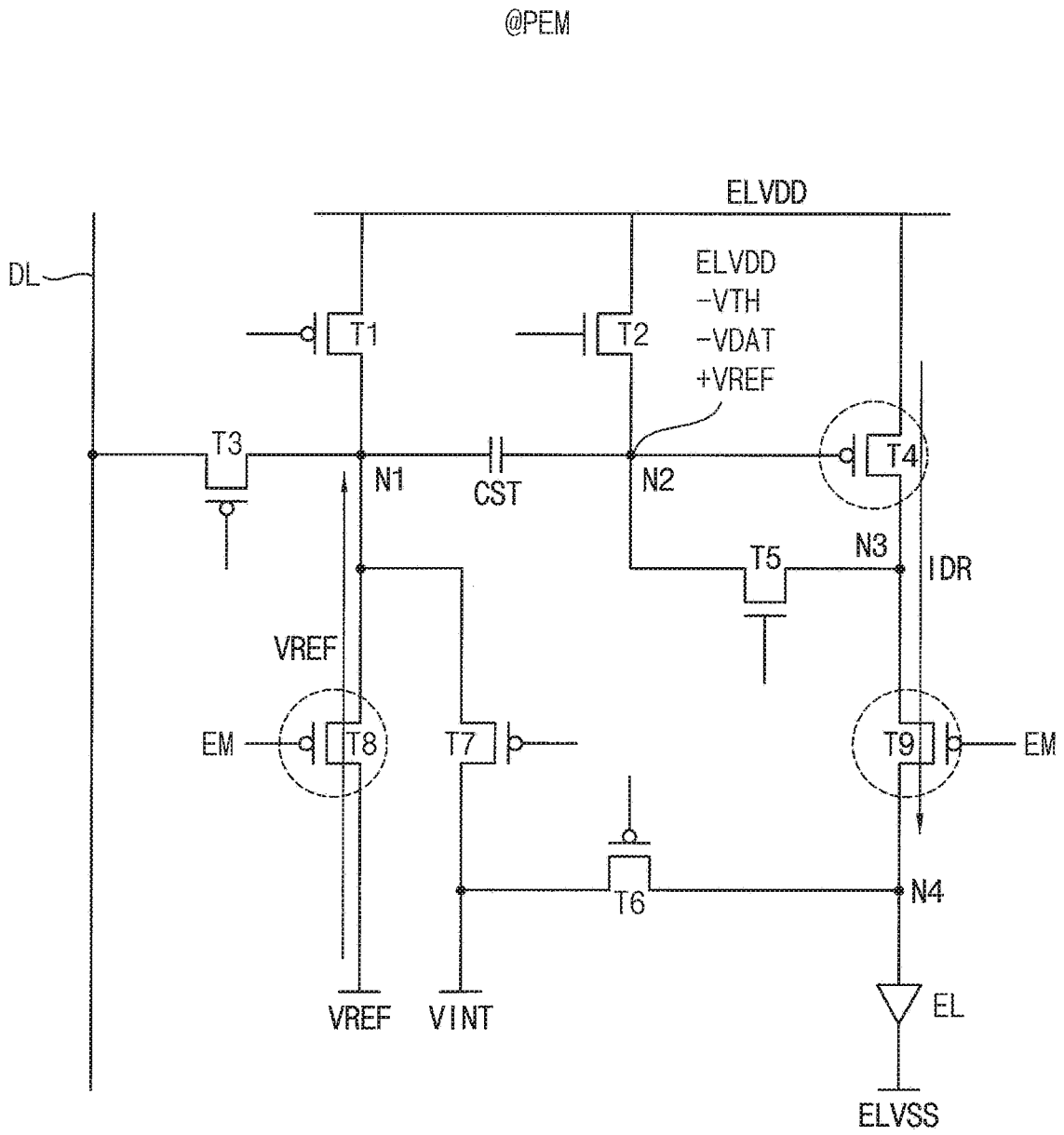
FIG. 6 is a circuit diagram for an example operation of a pixel of FIG. 1 in an emission period.

FIG. 2 is a timing diagram for an example operation of the pixel 100 of FIG. 1 at normal frequency driving, FIG. 3 is a circuit diagram for an example operation of the pixel 100 of FIG. 1 in an initialization period, FIG. 4 is a circuit diagram for an example operation of the pixel 100 of FIG. 1 in a threshold voltage compensation period, FIG. 5 is a circuit diagram for an example operation of the pixel 100 of FIG. 1 in a bias period, and FIG. 6 is a circuit diagram for an example operation of the pixel 100 of FIG. 1 in an emission period.

Referring to FIG. 2, when the OLED display device performs normal frequency driving that drives a display panel at a normal frequency (e.g., about 60 Hz or about 120 Hz), each frame period FP of the OLED display device may include an initialization period PINIT, a threshold voltage compensation period PVTH, a bias period PBIAS, and an emission period PEM. In the initialization period PINIT, the threshold voltage compensation period PVTH, and the bias period PBIAS, the emission signal EM having an off level, or a high level, may be applied to the pixel 100.

In the initialization period PINIT, as illustrated in FIGS. 2 and 3, the first initialization signal GI_P having a low level as an active level, or an on level, may be applied, and the second initialization signal GI_N having a high level as the active level, or the on level, may be applied. The first transistor T1 may apply the first power supply voltage ELVDD to the first node N1 in response to the first initialization signal GI_P having the low level, and the second transistor T2 may apply the first power supply voltage ELVDD to the second node N2 in response to the second initialization signal GI_N having the high level. The capacitor CST may be initialized based on the first power supply voltage ELVDD at both the first node N1 and the second node N2. The capacitor CST may be discharged based on the first power supply voltage ELVDD at both the first electrode and the second electrode of the capacitor CST. Since the first power supply voltage ELVDD is applied to the second node N2 when the capacitor CST is initialized, the first power supply voltage ELVDD may be applied to the first terminal (e.g., a source) of the fourth transistor T4 and the gate of the fourth transistor T4. Accordingly, when the capacitor CST is initialized, a gate-source voltage of about 0V may be applied to the fourth transistor T4.

In the threshold voltage compensation period PVTH, as illustrated in FIGS. 2 and 4, the data voltage VDAT may be provided through the data line DL, the first writing signal GW_P having the low level as the active level, or the on level may be applied, and the second writing signal GW_N having the high level as the active level, or the on level may be applied. The third transistor T3 may apply the data voltage VDAT provided through the data line DL to the first node N1 in response to the first writing signal GW_P having the low level, and the fifth transistor T5 may diode-connect the fourth transistor T4 in response to the second writing signal GW_N having the high level. Accordingly, in the threshold voltage compensation period PVTH, the data voltage VDAT may be stored at the first electrode of the capacitor CST, and a voltage (or "ELVDD−VTH") corresponding to the first power supply voltage ELVDD subtracted with the threshold voltage VTH of the fourth transistor T4 may be stored at the second electrode of the capacitor CST. This operation of the fifth transistor T5 that diode-connects the fourth transistor T4 to store the voltage (or "ELVDD−VTH") corresponding to the first power supply voltage ELVDD from which the threshold voltage VTH of the fourth transistor T4 is subtracted at the second electrode of the capacitor CST may be referred to as a threshold voltage compensating operation.

In the bias period PBIAS, as illustrated in FIGS. 2 and 5, the scan signal SS having the low level as the active level, or the on level may be applied. The sixth transistor T6 may apply the initialization voltage VINT to the fourth node N4 in response to the scan signal SS having the low level, and the seventh transistor T7 may apply the initialization voltage VINT to the first node N1 in response to the scan signal SS having the low level. Accordingly, the OLED EL may be initialized based on the initialization voltage VINT at the fourth node N4. In some example embodiments, the initialization voltage VINT may be substantially the same as the second power supply voltage ELVSS (e.g., about −3.5V), and a parasitic capacitor of the OLED EL may be discharged based on the initialization voltage VINT at the anode of the OLED EL and the second power supply voltage ELVSS at the cathode of the OLED EL.

Further, the initialization voltage VINT applied to the first node N1 by the seventh transistor T7 may change a voltage of the first electrode of the capacitor CST from the data voltage VDAT to the initialization voltage VINT. That is, the voltage of the first electrode of the capacitor CST may be changed by a voltage (or "VINT−VDAT") corresponding to the initialization voltage VINT from which the data voltage VDAT is subtracted. In this case, by coupling with the first electrode of the capacitor CST, a voltage of the second electrode of the capacitor CST may also be changed by the voltage (or "VINT−VDAT") corresponding to the initialization voltage VINT from which the data voltage VDAT is subtracted. Accordingly, the voltage of the second electrode of the capacitor CST may be changed from the voltage (or "ELVDD−VTH") corresponding to the first power supply voltage ELVDD from which the threshold voltage VTH is subtracted, by the voltage (or "VINT−VDAT") corresponding to the initialization voltage VINT from which the data voltage VDAT is subtracted, and thus to a voltage (or "ELVDD−VTH+VINT−VDAT") corresponding to the first power supply voltage ELVDD minus the threshold voltage VTH plus the initialization voltage VINT minus the data voltage VDAT. In some example embodiments, the initialization voltage VINT may be a negative voltage or may be substantially the same as the second power supply voltage ELVSS (e.g., about −3.5V), and thus the voltage (or "ELVDD−VTH+VINT−VDAT") of the second electrode of the capacitor CST in the bias period PBIAS may be lower than the first power supply voltage ELVDD. Accordingly, a bias voltage, e.g., an on-bias voltage, may be applied to the fourth transistor T4, and a hysteresis of the fourth transistor T4, or the driving transistor, may be initialized or compensated in the bias period PBIAS.

In the emission period PEM, as illustrated in FIGS. 2 and 6, the emission signal EM having the low level as the active level, or the on level may be applied. The eighth transistor T8 may apply the reference voltage VREF to the first node N1 in response to the emission signal EM having the low level, the fourth transistor T4 may generate a driving current based on the voltage of the second electrode of the capacitor CST, the ninth transistor T9 may couple the third node N3 to the fourth node N4 in response to the emission signal EM having the low level, and the OLED EL may emit light based on the driving current generated by the fourth transistor T4. The eighth transistor T8 that is turned on in response to the emission signal EM may change the voltage of the first electrode of the capacitor CST from the initialization voltage VINT to the reference voltage VREF at the first node N1, and thus the voltage of the second electrode of the capacitor CST may be changed, by coupling with the first electrode of the capacitor CST, to a voltage (or "ELVDD−VTH−VDAT+VREF") corresponding to the first power supply voltage ELVDD minus the threshold voltage VTH minus the data voltage VDAT plus the reference voltage VREF. Accordingly, the fourth transistor T4 may generate, regardless of the threshold voltage VTH of the fourth transistor T4, the driving current based on the data voltage VDAT and the reference voltage VREF. In some example embodiments, the reference voltage VREF may be, but is not limited to, about 0V.

Hereinafter, an example of operating the pixel 100 of FIG. 1 at low frequency driving will be described below with reference to FIGS. 1, 7, and 8.

Figure 7:
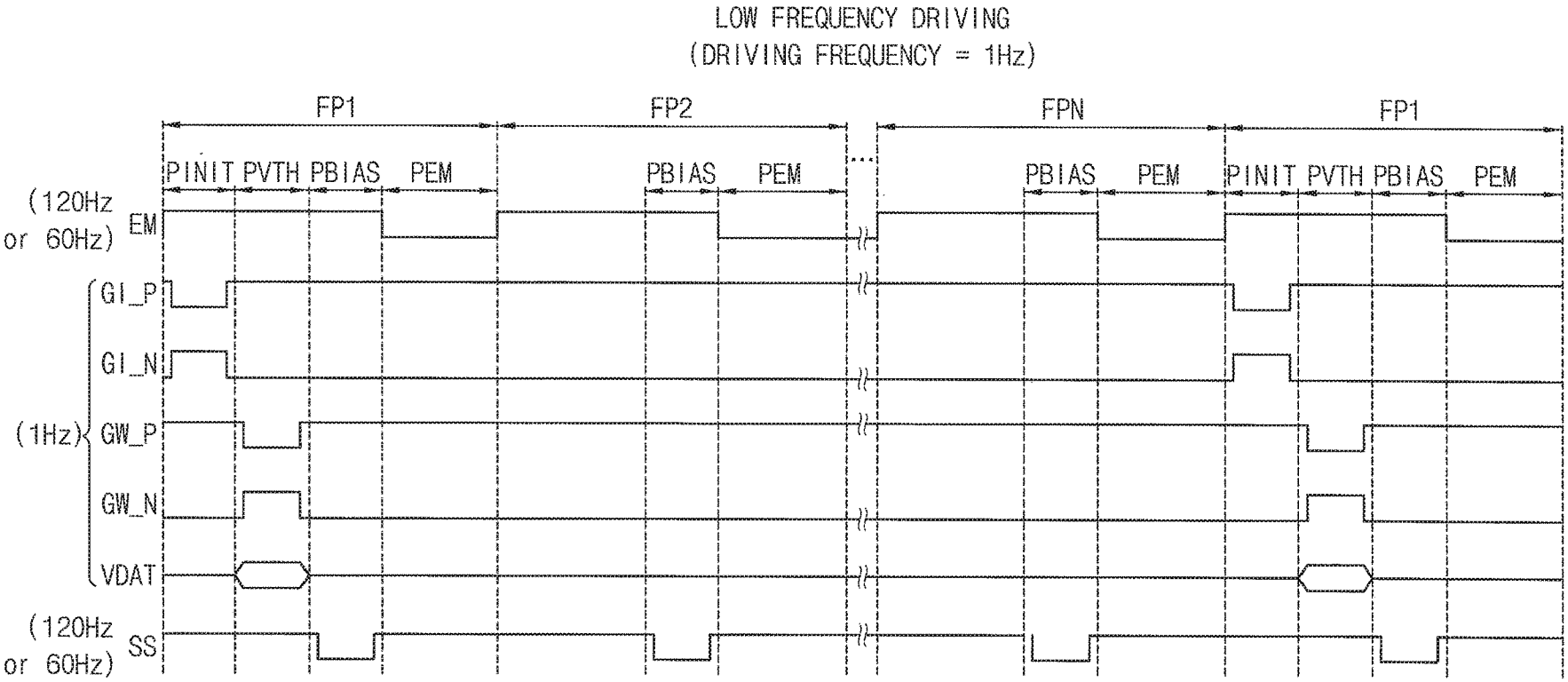
FIG. 7 is a timing diagram for an example operation of a pixel of FIG. 1 at low frequency driving.
Figure 8:
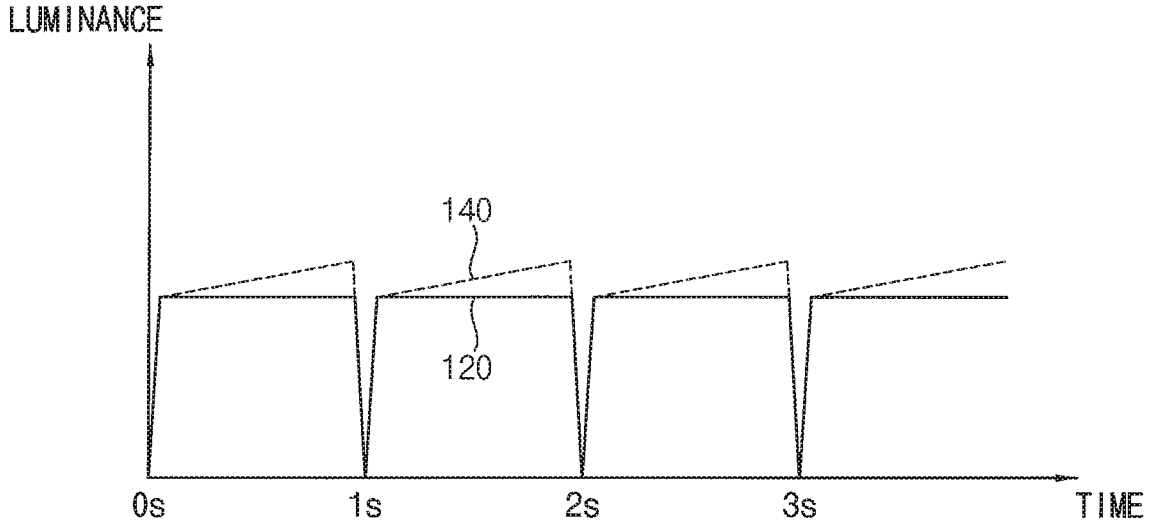
FIG. 8 is a diagram illustrating an example of luminance of an OLED display device including a pixel of FIG. 1 at low frequency driving.

FIG. 7 is a timing diagram for an example operation of the pixel 100 of FIG. 1 at low frequency driving, and FIG. 8 is a diagram illustrating an example of luminance of the OLED display device including the pixel 100 of FIG. 1 at low frequency driving.

Referring to FIGS. 1 and 7, when the OLED display device performs low frequency driving that drives the display panel of the OLED display device at a low frequency (e.g., about 1 Hz) lower than the normal frequency (e.g., about 60 Hz or about 120 Hz) in at least one frame period (e.g., the first frame period FP1) of a plurality of consecutive frame periods FP1, FP2, . . . , FPN. The low frequency frame period, or the first frame period FP1, of the OLED display device may include the initialization period PINIT, the threshold voltage compensation period PVTH, the bias period PBIAS, and the emission period PEM, and each of remaining frame periods FP2, . . . , FPN of the plurality of frame periods FP1, FP2, . . . , FPN may include only the bias period PBIAS and the emission period PEM. Here, the normal frequency may refer to a driving frequency of the display panel at the normal frequency driving. In some example embodiments, the normal frequency may be an input frame frequency of input image data provided to the OLED display device. Further, the low frequency may be a driving frequency at the low frequency driving, and may be any frequency lower than the normal frequency. In some example embodiments, the OLED display device may perform the low frequency driving that drives the display panel at the low frequency when the input image data provided to the OLED display device represents a still image. In other example embodiments, the OLED display device may receive a mode signal indicating a low frequency driving mode from a host processor, and may perform the low frequency driving in response to the mode signal indicating the low frequency driving.

For example, in a case where the normal frequency of the OLED display device is about 60 Hz, and the OLED display device may perform the low frequency driving with the low frequency of about 1 Hz. In this case, the first frame period FP1 among 60 consecutive frame periods FP1, FP2, . . . , FPN may include the initialization period PINIT, the threshold voltage compensation period PVTH, the bias period PBIAS, and the emission period PEM, and each of the remaining 59 frame periods FP2, . . . , FPN of the 60 frame periods FP1, FP2, . . . , FPN may include only the bias period PBIAS and the emission period PEM. In another example, in a case where the normal frequency of the OLED display device is about 120 Hz, and the OLED display device may perform the low frequency driving with the low frequency of about 10 Hz, the first frame period FP1 among 12 consecutive frame periods FP1, FP2, . . . , FPN may include the initialization period PINIT, the threshold voltage compensation period PVTH, the bias period PBIAS, and the emission period PEM, and each of the remaining 11 frame periods FP2, . . . , FPN of the 12 frame periods FP1, FP2, . . . , FPN may include only the bias period PBIAS and the emission period PEM. As described above, at the low frequency driving, a ratio of the number of the first frame periods FP1 including the four periods PINIT, PVTH, PBIAS, and PEM to the number of the entire frame periods FP1, FP2, . . . , FPN may be determined as a ratio of the low frequency to the normal frequency.

Since the first frame period FP1 of the plurality of frame periods FP1, FP2, . . . , FPN may include the four periods PINIT, PVTH, PBIAS, and PEM, and each of the remaining frame periods FP2, . . . , FPN may include only the bias period PBIAS and the emission period PEM, the scan signal SS applied in the bias period PBIAS and the emission signal EM applied in the emission period PEM may be provided at the normal frequency (e.g., about 60 Hz or about 120 Hz) while the first and second initialization signals GI_P and GI_N, the first and second writing signals GW_P and GW_N, and the data voltage VDAT may be provided at the low frequency (e.g., about 1 Hz). Accordingly, power consumption of the OLED display device may be reduced when the display panel is driven at the low frequency.

In the example of the low frequency driving illustrated in FIG. 7, the first frame period FP1 may include the initialization period PINIT, the threshold voltage compensation period PVTH, the bias period PBIAS, and the emission period PEM. In the initialization period PINIT, the first and second initialization signals GI_P and GI_N may be applied, and the capacitor CST may be initialized. In the threshold voltage compensation period PVTH, the first and second writing signals GW_P and GW_N may be applied, the data voltage VDAT may be provided to the first electrode of the capacitor CST, and the first power supply voltage ELVDD subtracted by the threshold voltage VTH, i.e., ELVDD-VTH, may be stored at the second electrode of the capacitor CST such that the threshold voltage VTH of the fourth transistor T4 may be compensated. In the bias period PBIAS, the scan signal SS may be applied, the OLED EL may be initialized, the voltage of the second electrode of the capacitor CST may be changed based on the initialization voltage VINT applied to the first electrode of the capacitor CST, and a bias voltage, for example an on-bias voltage, may be applied to the fourth transistor T4 based on the changed voltage of the second electrode of the capacitor CST. In the emission period PEM, the emission signal EM may be applied, and the OLED EL may emit light.

Each of subsequent frame periods, i.e., the second through N-th frame periods FP2, . . . , FPN, may include only the bias period PBIAS and the emission period PEM, where N is an integer greater than 1. In the bias period PBIAS of a subsequent frame period, the OLED EL may be initialized, and the bias voltage, for example the on-bias voltage, may be applied to the fourth transistor T4. Accordingly, at the low frequency driving, although the first and second initialization signals GI_P and GI_N, the first and second writing signals GW_P and GW_N, and the data voltage VDAT may not be provided in the second through N-th frame periods FP2, . . . , FPN, the on-bias voltage may be applied to the fourth transistor T4, and thus the hysteresis of the fourth transistor T4 may be periodically initialized or compensated. Further, in the emission period PEM, the OLED EL may emit light. Thus, at the low frequency driving, the OLED EL may emit light with luminance substantially the same as luminance at the normal frequency driving.

As a comparative example of a conventional OLED display device that performs the low frequency driving, a storage capacitor, or the capacitor CST, may be initialized by using the initialization voltage VINT in the first frame period FP1, and at this time, the initialization voltage VINT (e.g., of about −3.5V) may be applied to a gate of a driving transistor, or the fourth transistor T4, of each pixel, and a gate-source voltage having a high absolute value may be applied as a bias voltage to the driving transistor. Further, in the subsequent frame periods FP2, . . . , FPN, the bias voltage may not be applied to the driving transistor. In this case, a threshold voltage of the driving transistor may be shifted in a negative direction (i.e., a negative shift of the threshold voltage may occur) in the first frame period FP1, and the threshold voltage may be gradually shifted in a positive direction in the subsequent frame periods FP2, . . . , FPN. Referring to FIG. 8, at the low frequency driving with the low frequency of about 1 Hz, luminance 140 of the conventional OLED display device may gradually increase for each period corresponding to the low frequency of about 1 Hz, in the present example, one second. However, in the pixel 100, a voltage (i.e., the first power supply voltage ELVDD) for initializing the capacitor CST and a voltage (i.e., the initialization voltage VINT) for initializing the OLED EL may be different from each other, and a gate-source voltage having a low absolute value (e.g., in case of the pixel 100 of FIG. 1, about 0V) may be applied to the driving transistor, or the fourth transistor T4, when the capacitor CST is initialized. Accordingly, in the pixel 100, luminance 120 of the present OLED display device may be maintained at the substantially constant level at low frequency driving without being gradually increasing in comparison with the luminance 140 of the conventional OLED display device.

Figure 9:
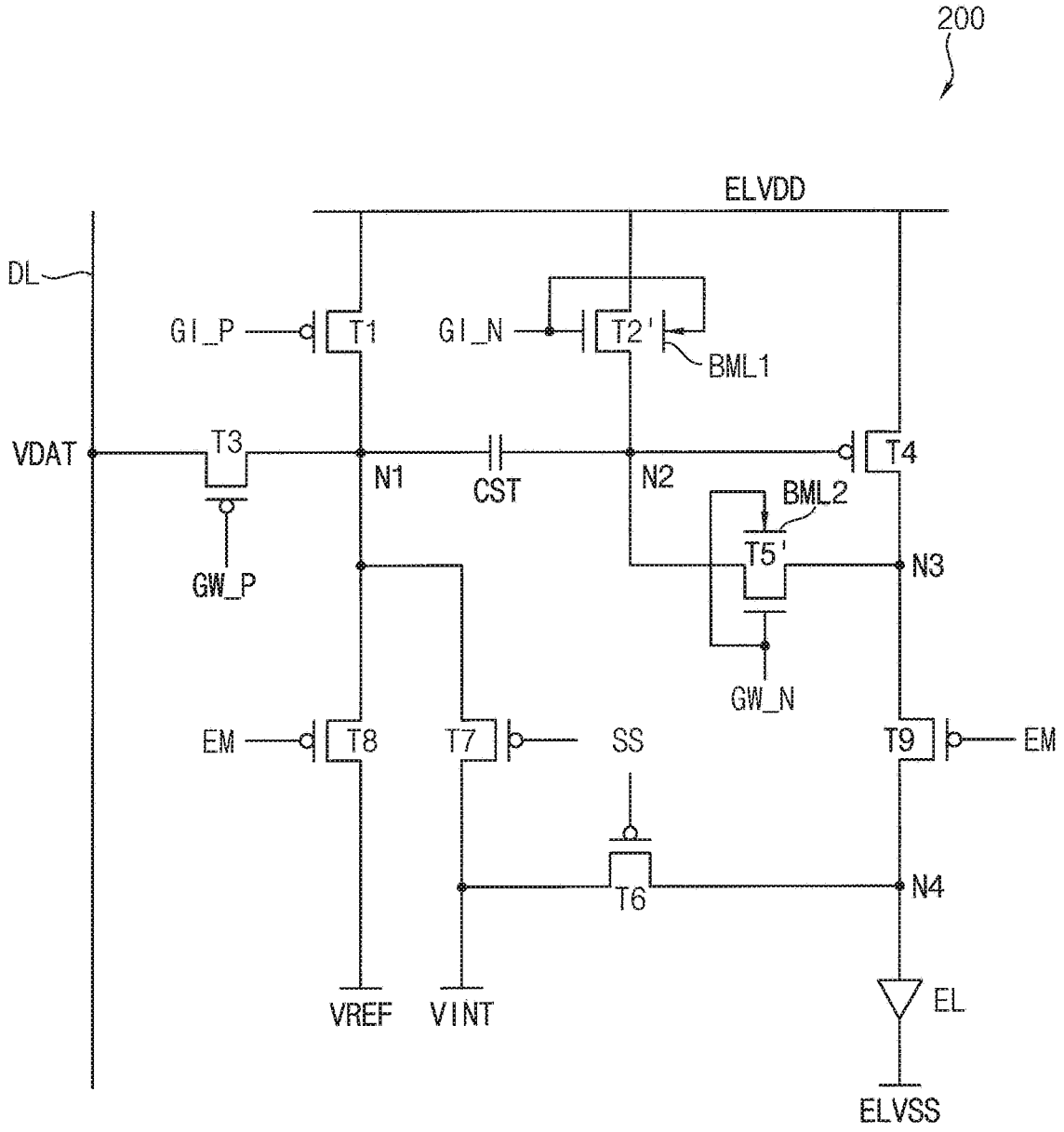
FIG. 9 is a circuit diagram illustrating a pixel of an OLED display device according to an example embodiment.

FIG. 9 is a circuit diagram illustrating a pixel of an OLED display device according to an example embodiment.

Referring to FIG. 9, a pixel 200 of an OLED display device may include the capacitor CST, first through ninth transistors T1, T2', T3, T4, T5', T6, T7, T8, and T9, and the OLED EL. The pixel 200 may have a similar configuration and a similar operation to the pixel 100 of FIG. 1 except that the second and fifth transistors T2' and T5' may further include first and second bottom electrodes BML1 and BML2.

The second transistor T2' may include a gate receiving the second initialization signal GI_N, a first terminal receiving the first power supply voltage ELVDD, a second terminal coupled to the second node N2, and the first bottom electrode BML1 receiving the second initialization signal GI_N. In some example embodiments, the first bottom electrode BML1 may be disposed under the gate of the second transistor T2'. Accordingly, the first bottom electrode BML1 may block internal light and/or external light to prevent a characteristic change of the second transistor T2' by the internal light and/or the external light. For example, the first bottom electrode BML1 may block light (e.g., infrared light) emitted by a light sensor (e.g., an infrared sensor) located under the second transistor T2'. In some example embodiments, the first bottom electrode BML1 may include, but is not limited to, molybdenum (Mo). In other example embodiments, the first bottom electrode BML1 may include a low-resistance opaque conductive material, such as aluminium (Al), an Al alloy, tungsten (W), copper (Cu), nickel (Ni), chromium (Cr), titanium (Ti), platinum (Pt), tantalum (Ta), etc.

The fifth transistor T5' may include a gate receiving the second writing signal GW_N, a first terminal coupled to the third node N3, a second terminal coupled to the second node N2, and the second bottom electrode BML2 receiving the second writing signal GW_N. In some example embodiments, the second bottom electrode BML2 may be disposed under the gate of the fifth transistor T5'. Accordingly, the second bottom electrode BML2 may block internal light and/or external light to prevent a characteristic change of the fifth transistor T5' by the internal light and/or the external light. In some example embodiments, the second bottom electrode BML2 may include, but is not limited to, Mo. In other example embodiments, the second bottom electrode BML2 may include a low-resistance opaque conductive material, such as Al, an Al alloy, W, Cu, Ni, Cr, Ti, Pt, Ta, etc.

Figure 10:
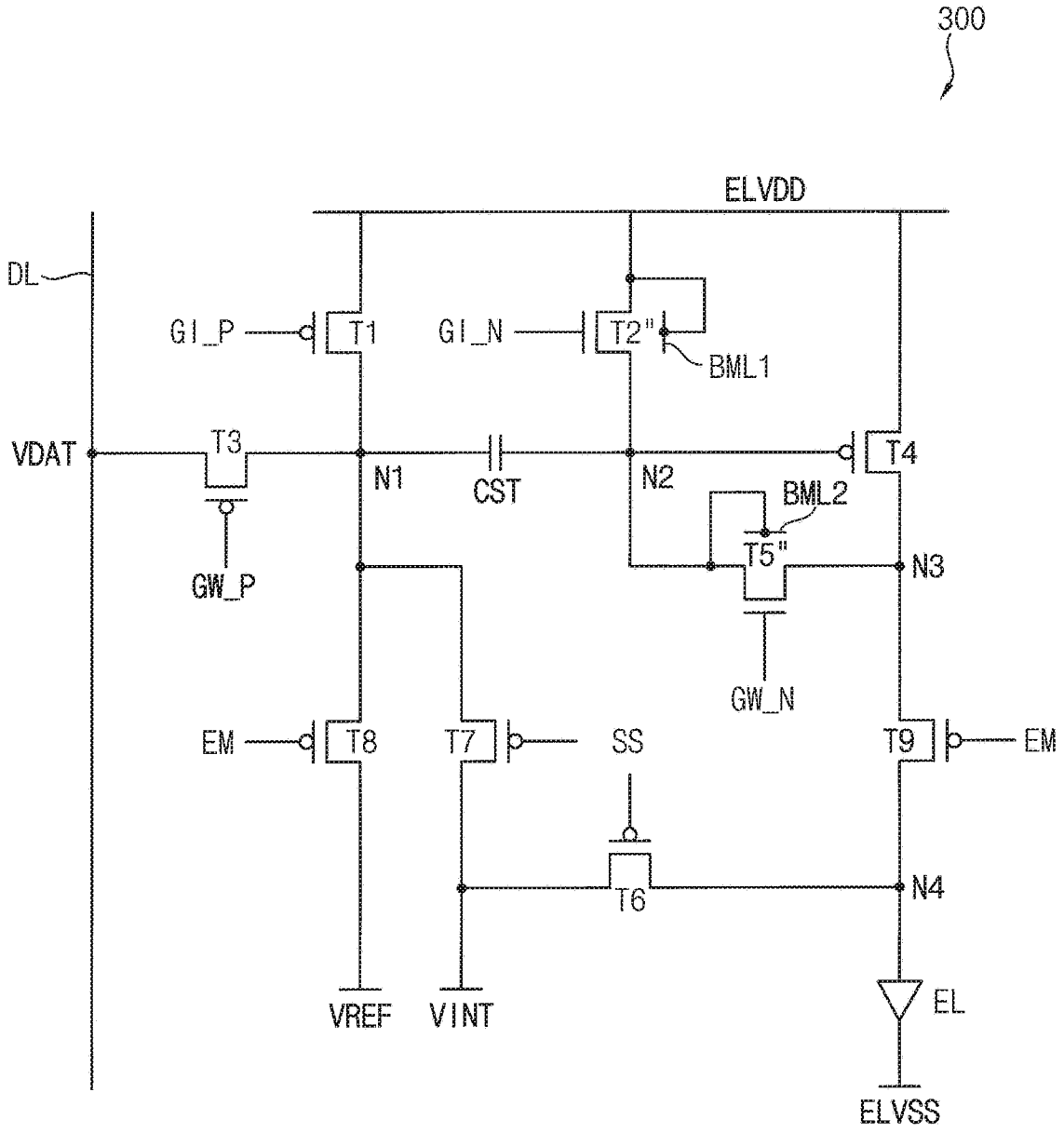
FIG. 10 is a circuit diagram illustrating a pixel of an OLED display device according to an example embodiment.

FIG. 10 is a circuit diagram illustrating a pixel of an OLED display device according to an example embodiment.

Referring to FIG. 10, a pixel 300 of an OLED display device may include the capacitor CST, first through ninth transistors T1, T2", T3, T4, T5", T6, T7, T8, and T9, and the OLED EL. The pixel 300 may have a similar configuration and a similar operation to the pixel 100 of FIG. 1 except that the second and fifth transistors T2" and T5" may further include the first and second bottom electrodes BML1 and BML2.

The second transistor T2" may include a gate receiving the second initialization signal GI_N, a first terminal receiving the first power supply voltage ELVDD, a second terminal coupled to the second node N2, and the first bottom electrode BML1 coupled to the first terminal of the second transistor T2". In some example embodiments, the first bottom electrode BML1 may be disposed under the gate of the second transistor T2". In some example embodiments, the first bottom electrode BML1 may include, but is not limited to, Mo. In other example embodiments, the first bottom electrode BML1 may include a low-resistance opaque conductive material, such as Al, an Al alloy, W, Cu, Ni, Cr, Ti, Pt, Ta, etc.

The fifth transistor T5" may include a gate receiving the second writing signal GW_N, a first terminal coupled to the third node N3, a second terminal coupled to the second node N2, and the second bottom electrode BML2 coupled to the second terminal of the fifth transistor T5". In some example embodiments, the second bottom electrode BML2 may be disposed under the gate of the fifth transistor T5". In some example embodiments, the second bottom electrode BML2 may include, but is not limited to, Mo. In other example embodiments, the second bottom electrode BML2 may include a low-resistance opaque conductive material, such as Al, an Al alloy, W, Cu, Ni, Cr, Ti, Pt, Ta, etc.

Figure 11:
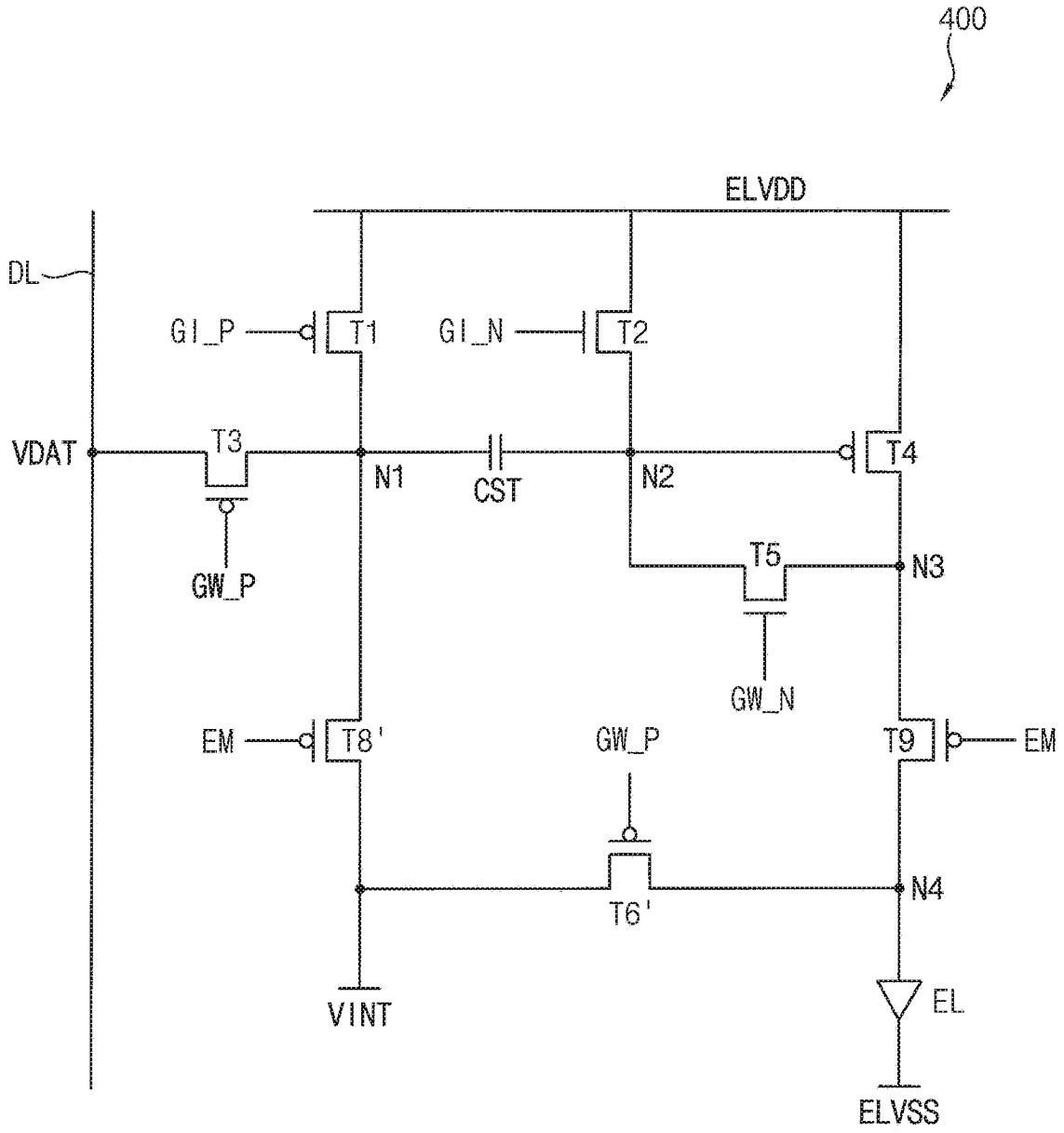
FIG. 11 is a circuit diagram illustrating a pixel of an OLED display device according to an example embodiment.

FIG. 11 is a circuit diagram illustrating a pixel of an OLED display device according to an example embodiment.

Referring to FIG. 11, a pixel 400 of an OLED display device may include the capacitor CST, first, second, third, fourth, fifth, sixth, eighth, and ninth transistors T1, T2, T3, T4, T5, T6', T8', and T9, and the OLED EL. The pixel 400 may have a similar configuration and a similar operation to the pixel 100 of FIG. 1 except that the pixel 400 may not include the seventh transistor T7, the sixth transistor T6' may receive the first writing signal GW_P instead of the scan signal SS, and the eighth transistor T8' may transfer the initialization voltage VINT instead of the reference voltage VREF to the first node N1.

In the pixel 400 of FIG. 11, the capacitor CST may include a first electrode coupled to the first node N1, and a second electrode coupled to a second node N2, the first transistor T1 may include a gate receiving the first initialization signal GI_P, a first terminal receiving the first power supply voltage ELVDD, and a second terminal coupled to the first node N2, the second transistor T2 may include a gate receiving the second initialization signal GI_N, a first terminal receiving the first power supply voltage ELVDD, and a second terminal coupled to the second node N2, the third transistor T3 may include a gate receiving the first writing signal GW_P, a first terminal coupled to the data line DL, and a second terminal coupled to the first node N1, the fourth transistor T4 may include a gate coupled to the second node N2, a first terminal receiving the first power supply voltage ELVDD, and a second terminal coupled to the third node N3, the fifth transistor T5 may include a gate receiving the second writing signal GW_N, a first terminal coupled to the third node N3, and a second terminal coupled to the second node N2, the sixth transistor T6' may include a gate receiving the first writing signal GW_P, a first terminal receiving the initialization voltage VINT, and a second terminal coupled to the fourth node N4, the eighth transistor T8' may include a gate receiving the emission signal EM, a first terminal receiving the initialization voltage VINT, and a second terminal coupled to the first node N1, the ninth transistor T9 may include a gate receiving the emission signal EM, a first terminal coupled to the third node N3, and a second terminal coupled to the fourth node N4, and the OLED EL may include an anode coupled to the fourth node N4, and a cathode receiving the second power supply voltage ELVSS.

In some example embodiments, as illustrated in FIG. 11, the first, third, fourth, sixth, eighth, and ninth transistors T1, T3, T4, T6', T8', and T9 may be PMOS transistors, and the second and fifth transistors T2 and T5 may be NMOS transistors. In this case, since the second and fifth transistors T2 and T5 that are directly connected to the second node N2 (or the second electrode of the capacitor CST) are implemented with the NMOS transistors, a leakage current from the second electrode of the capacitor CST may be reduced. Accordingly, when the pixel 400 is driven at a low frequency lower than a normal frequency (e.g., about 60 Hz or about 120 Hz), a voltage of the second electrode of the capacitor CST may not vary substantially, and thus the pixel 400 may be suitable for low frequency driving.

Further, in the pixel 400, a voltage (i.e., the first power supply voltage ELVDD) for initializing the capacitor CST and a voltage (i.e., the initialization voltage VINT) for initializing the OLED EL may be different from each other, and a gate-source voltage having a low absolute value (e.g., in case of the pixel 400 of FIG. 11, about 0V) may be applied to the driving transistor, or the fourth transistor T4, when the capacitor CST is initialized. Accordingly, in the pixel 400, luminance of the OLED display device may be maintained at the substantially constant level, preventing a gradual increase of luminance at low frequency driving.

Hereinafter, an example of operating the pixel 400 of FIG. 11 at normal frequency driving will be described below with reference to FIGS. 12 through 15.

Figure 12:
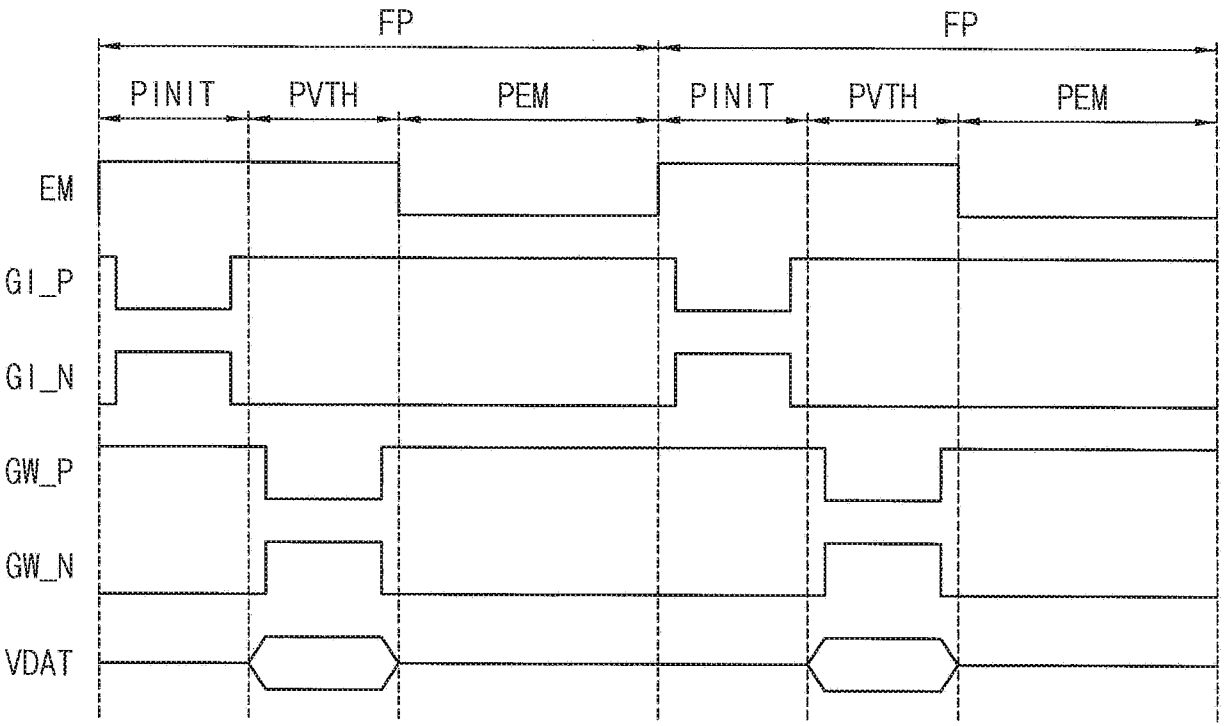
FIG. 12 is a timing diagram for an example operation of a pixel of FIG. 11 at normal frequency driving.
Figure 13:
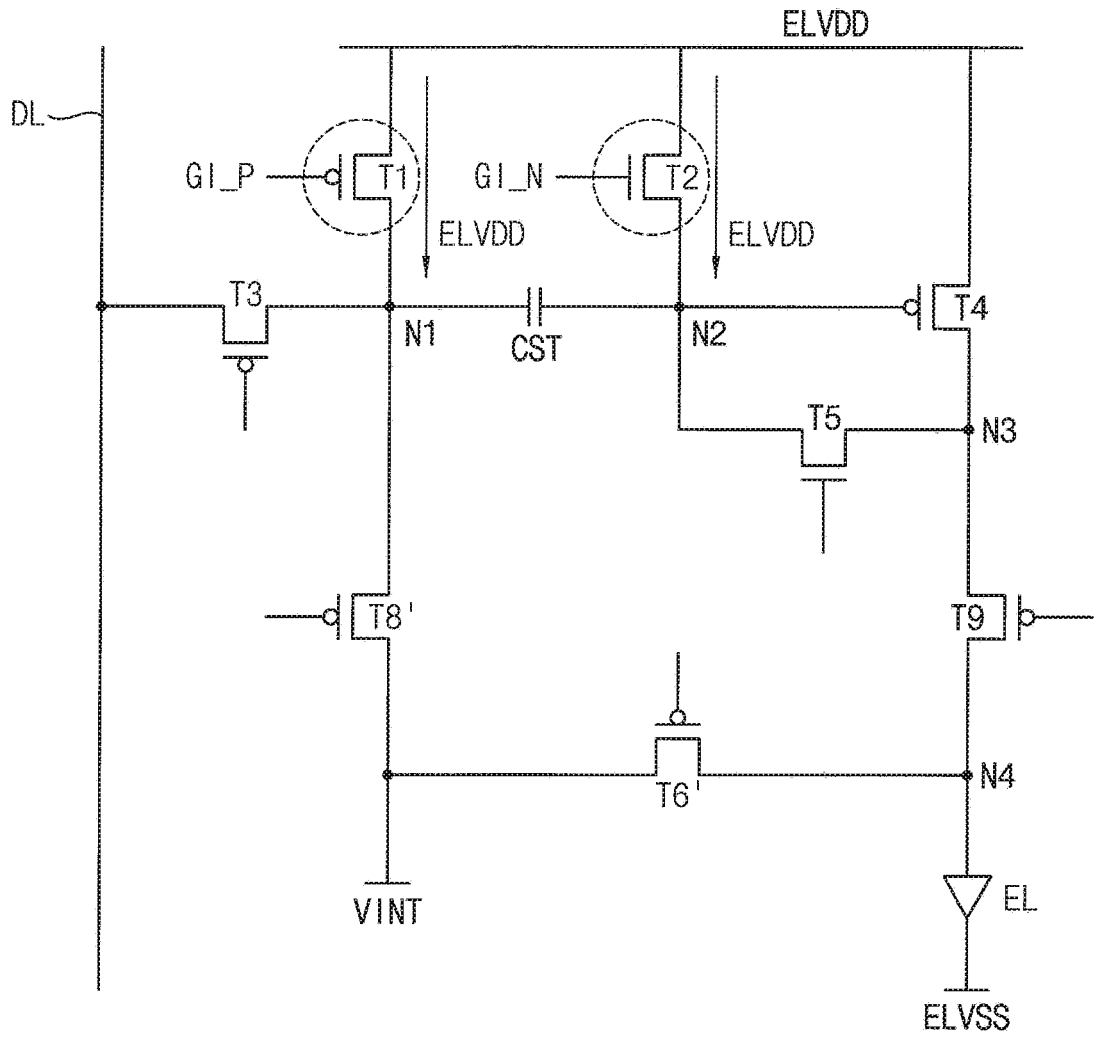
FIG. 13 is a circuit diagram for an example operation of a pixel of FIG. 11 in an initialization period.
Figure 14:
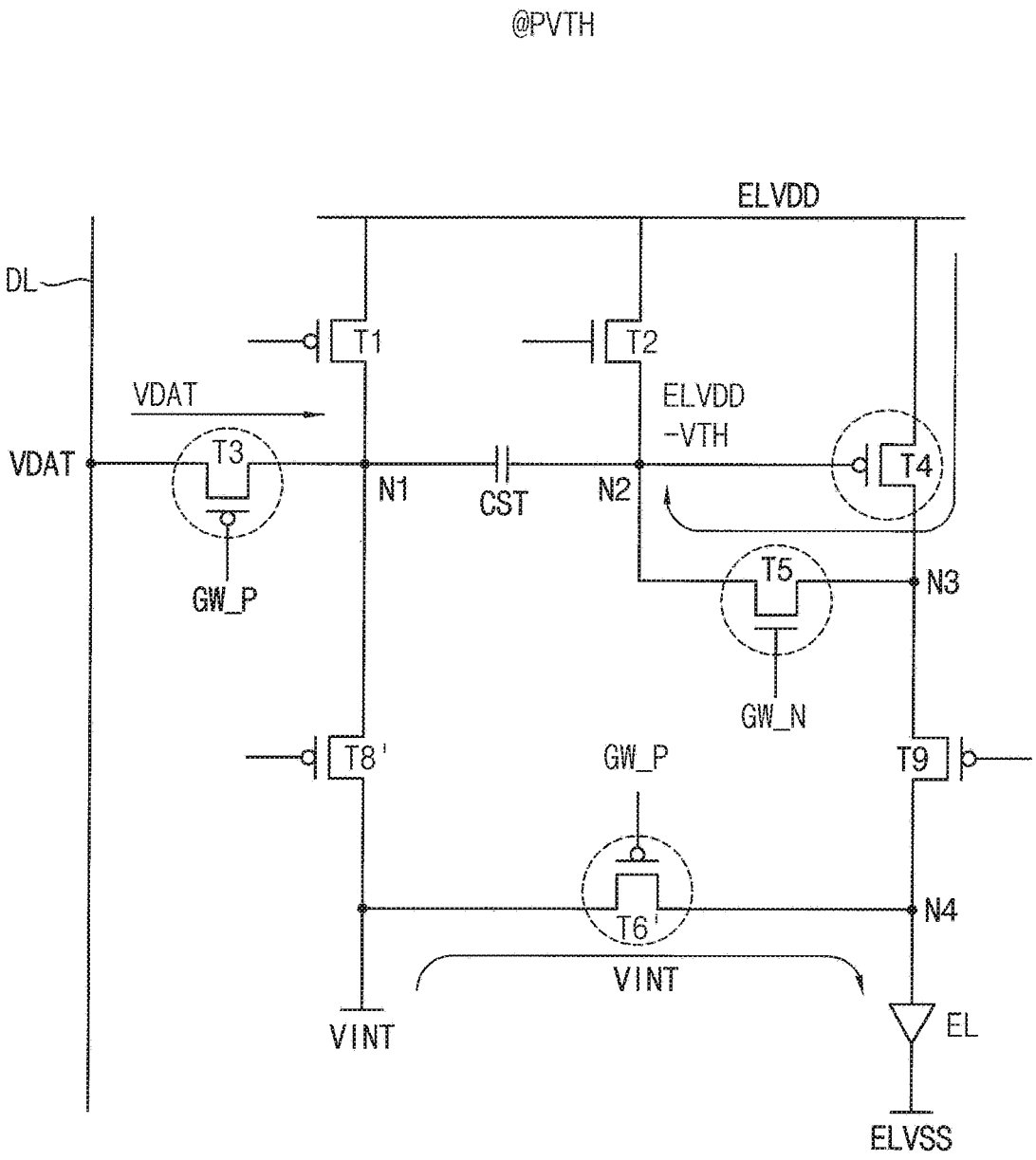
FIG. 14 is a circuit diagram for an example operation of a pixel of FIG. 11 in a threshold voltage compensation period.
Figure 15:
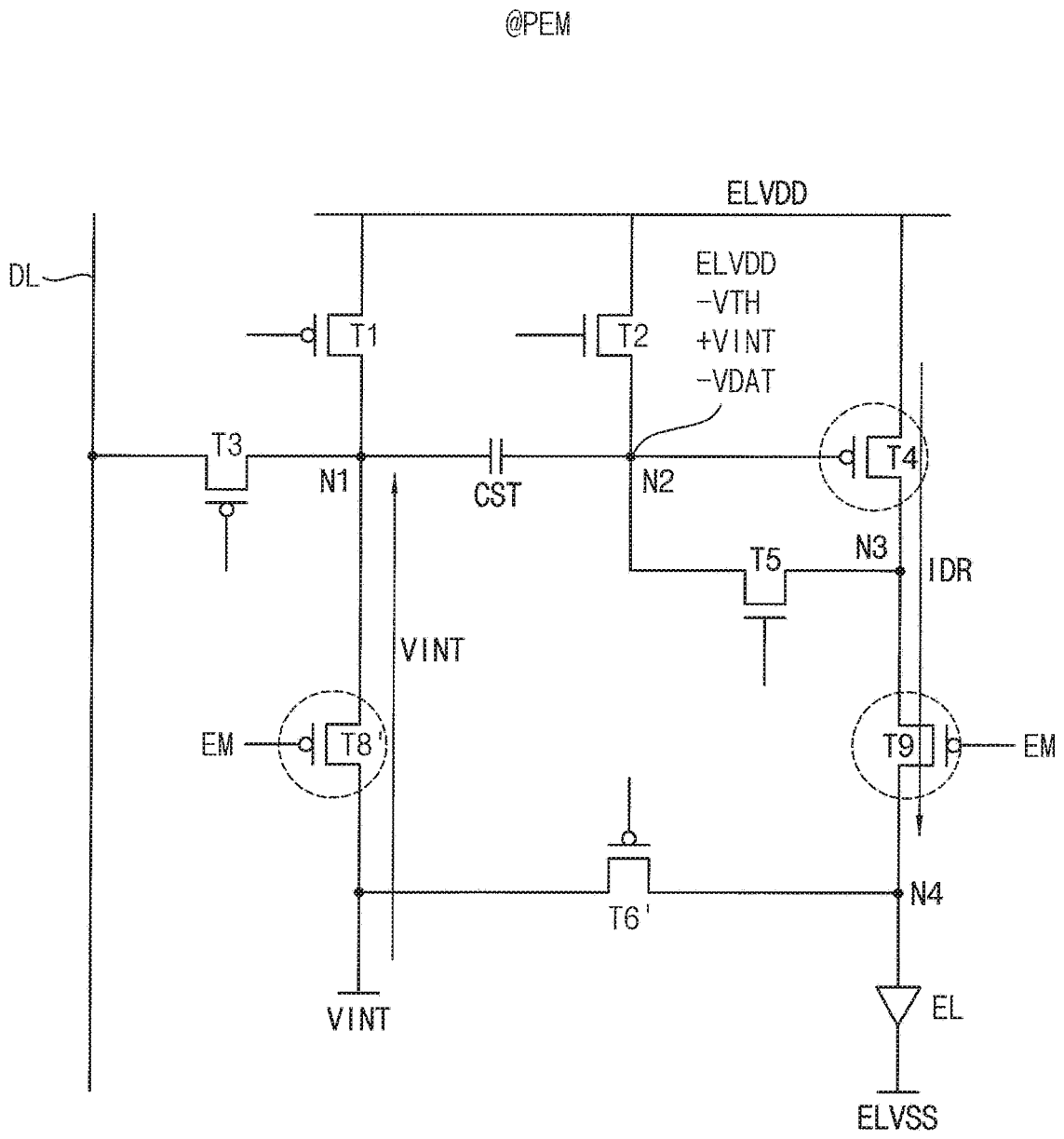
FIG. 15 is a circuit diagram for an example operation of a pixel of FIG. 11 in an emission period.

FIG. 12 is a timing diagram for an example operation of the pixel 400 of FIG. 11 at normal frequency driving, FIG. 13 is a circuit diagram for an example operation of a pixel of FIG. 11 in an initialization period, FIG. 14 is a circuit diagram for an example operation of the pixel 400 of FIG. 11 in a threshold voltage compensation period, and FIG. 15 is a circuit diagram for an example operation of the pixel 400 of FIG. 11 in an emission period.

Referring to FIG. 12, when the OLED display device performs normal frequency driving that drives a display panel at a normal frequency (e.g., about 60 Hz or about 120 Hz), each frame period FP of the OLED display device may include an initialization period PINIT, a threshold voltage compensation period PVTH, and an emission period PEM. In the initialization period PINIT and the threshold voltage compensation period PVTH, the emission signal EM having an off level, or a high level, may be applied to the pixel 400.

In the initialization period PINIT, as illustrated in FIGS. 12 and 13, the first and second transistors T1 and T2 may respectively apply the first power supply voltage ELVDD to the first and second nodes N1 and N2 in response to the first and second initialization signals GI_P and GI_N. The capacitor CST may be initialized or discharged based on the first power supply voltage ELVDD at both the first node N1 and the second node N2. While the capacitor CST is initialized, a gate-source voltage of about 0V may be applied to the fourth transistor T4. Accordingly, when the OLED display device including the pixel 400 performs low frequency driving, a gradual increase of luminance at the low frequency driving may be prevented.

In the threshold voltage compensation period PVTH, as illustrated in FIGS. 12 and 14, the third transistor T3 may apply the data voltage VDAT provided through the data line DL to the first node N1 in response to the first writing signal GW_P, and the fifth transistor T5 may diode-connect the fourth transistor T4 in response to the second writing signal GW_N. Accordingly, the data voltage VDAT may be stored at the first electrode of the capacitor CST, and a voltage (or "ELVDD−VTH") corresponding to the first power supply voltage ELVDD subtracted with the threshold voltage VTH of the fourth transistor T4 may be stored at the second electrode of the capacitor CST. Further, the sixth transistor T6' may apply the initialization voltage VINT to the fourth node N4 in response to the first writing signal GW_P, and the OLED EL may be initialized based on the initialization voltage VINT at the fourth node N4.

In the emission period PEM, as illustrated in FIGS. 12 and 15, the eighth transistor T8' may apply the initialization voltage VINT to the first node N1 in response to the emission signal EM, the fourth transistor T4 may generate a driving current based on a voltage of the second electrode of the capacitor CST, the ninth transistor T9 may couple the third node N3 to the fourth node N4 in response to the emission signal EM, and the OLED EL may emit light based on the driving current generated by the fourth transistor T4. The eighth transistor T8 that is turned on in response to the emission signal EM may change the voltage of the first electrode of the capacitor CST from the data voltage VDAT to the initialization voltage VINT at the first node N1, and thus the voltage of the second electrode of the capacitor CST may be changed, by coupling with the first electrode of the capacitor CST, to a voltage (or "ELVDD−VTH+VINT−VDAT") corresponding to the first power supply voltage ELVDD minus the threshold voltage VTH plus the initialization voltage VINT minus the data voltage VDAT. Accordingly, the fourth transistor T4 may generate, regardless of the threshold voltage VTH of the fourth transistor T4, the driving current based on the data voltage VDAT and the initialization voltage VINT. In some example embodiments, a voltage level of the data voltage VDAT may be determined by considering a voltage level of the initialization voltage VINT such that an amount of the driving current may be determined regardless of the initialization voltage VINT.

Hereinafter, an example operation of the pixel 400 of FIG. 11 at low frequency driving will be described below with reference to FIGS. 11 and 16.

Figure 16:
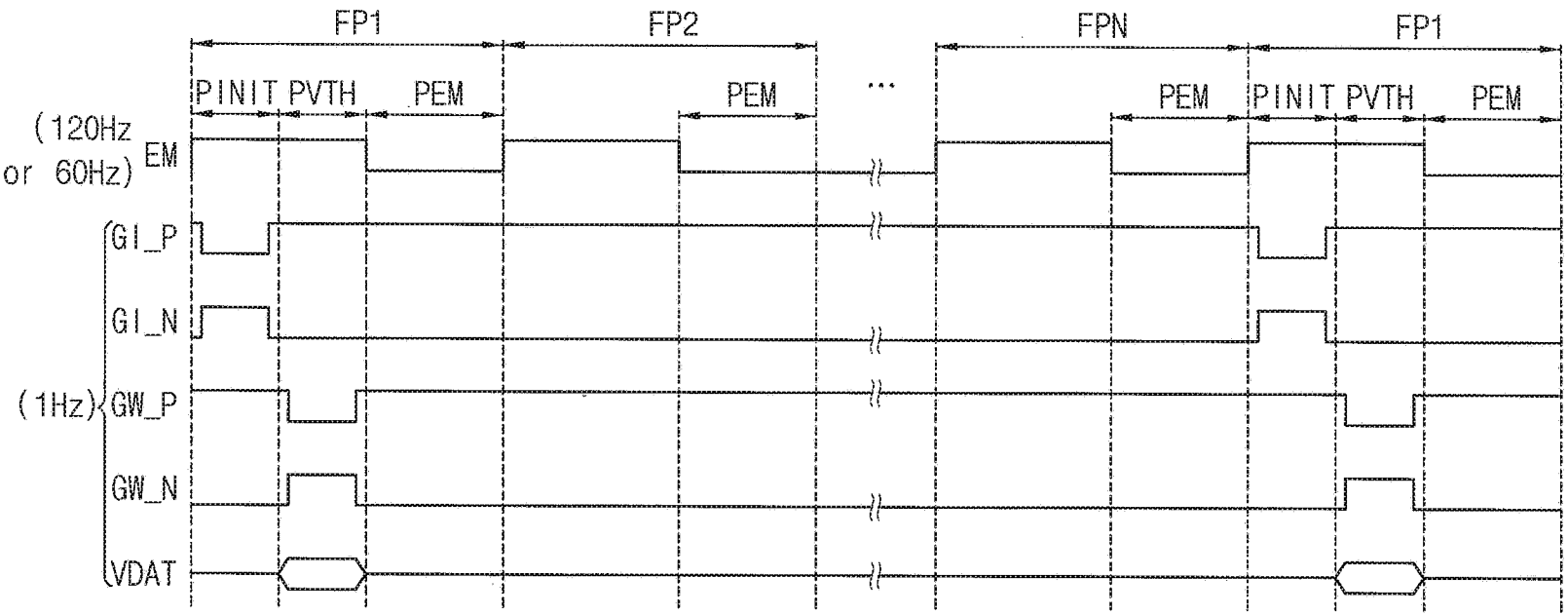
FIG. 16 is a timing diagram for an example operation of a pixel of FIG. 11 at low frequency driving.

FIG. 16 is a timing diagram for an example operation of the pixel 400 of FIG. 11 at low frequency driving.

Referring to FIGS. 11 and 16, when the OLED display device performs low frequency driving that drives the display panel of the OLED display device at a low frequency (e.g., about 1 Hz) lower than the normal frequency (e.g., about 60 Hz or about 120 Hz) in at least one frame period (e.g., the first frame period FP1) of a plurality of consecutive frame periods FP1, FP2, . . . , FPN. The low frequency frame period, or the first frame period FP1, of the OLED display device may include the initialization period PINIT, the threshold voltage compensation period PVTH, and the emission period PEM, and each of remaining frame periods FP2, . . . , FPN of the plurality of frame periods FP1, FP2, . . . , FPN may include only the emission period PEM.

Since the first frame period FP1 of the plurality of frame periods FP1, FP2, . . . , FPN may include the three periods PINIT, PVTH and PEM, and each of the remaining frame periods FP2, . . . , FPN may include only the emission period PEM, the emission signal EM applied in the emission period PEM may be provided at the normal frequency (e.g., about 60 Hz or about 120 Hz) while the first and second initialization signals GI_P and GI_N, the first and second writing signals GW_P and GW_N, and the data voltage VDAT may be provided at the low frequency (e.g., about 1 Hz). Accordingly, power consumption of the OLED display device may be reduced when the display panel is driven at the low frequency.

In the example of the low frequency driving illustrated in FIG. 16, the first frame period FP1 may include the initialization period PINIT, the threshold voltage compensation period PVTH, and the emission period PEM. In the initialization period PINIT, the first and second initialization signals GI_P and GI_N may be applied, and the capacitor CST may be initialized. In the threshold voltage compensation period PVTH, the first and second writing signals GW_P and GW_N may be applied, the data voltage VDAT may be provided to the first electrode of the capacitor CST, the first power supply voltage ELVDD subtracted by the threshold voltage VTH, i.e., ELVDD−VTH, may be stored at the second electrode of the capacitor CST such that the threshold voltage VTH of the fourth transistor T4 may be compensated, and the OLED EL may be initialized based on the initialization voltage VINT. In the emission period PEM, the OLED EL may emit light. Each of the subsequent frame periods, i.e., the second through N-th frame periods FP2, . . . , FPN, may include only the emission period PEM, in which the OLED EL may emit light.

In the pixel 400, a voltage (i.e., the first power supply voltage ELVDD) for initializing the capacitor CST and a voltage (i.e., the initialization voltage VINT) for initializing the OLED EL may be different from each other, and a gate-source voltage having a low absolute value (e.g., in case of the pixel 400 of FIG. 11, about 0V) may be applied to the driving transistor, or the fourth transistor T4, when the capacitor CST is initialized. Accordingly, in the pixel 400, luminance of the present OLED display device may be maintained at the substantially constant level, preventing the gradual increase of luminance at the low frequency driving.

Figure 17:
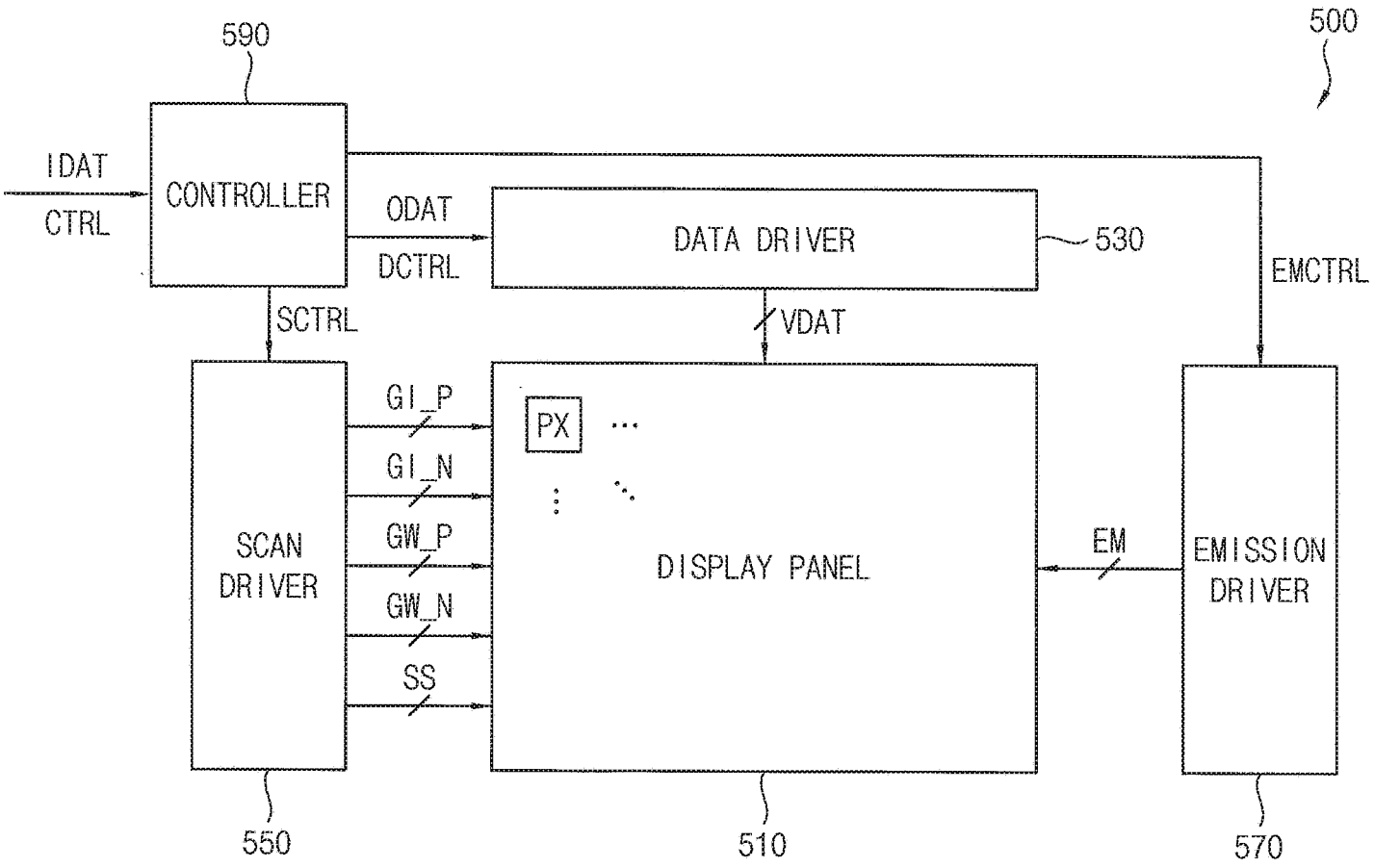
FIG. 17 is a block diagram illustrating an OLED display device according to an example embodiment.

FIG. 17 is a block diagram illustrating an OLED display device according to an example embodiment.

Referring to FIG. 17, an OLED display device 500 may include a display panel 510, a data driver 530, a scan driver 550, an emission driver 570, and a controller 590.

The display panel 510 may include a plurality of pixels PX. According to an example embodiment, each pixel PX may correspond to the pixel 100 of FIG. 1, the pixel 200 of FIG. 9, the pixel 300 of FIG. 10, or the pixel 400 of FIG. 11. Each pixel PX may be a hybrid oxide polycrystalline (HOP) pixel suitable for low frequency driving and capable of reducing power consumption. In the HOP pixel, at least one transistor may be implemented with an LTPS PMOS transistor, and at least another transistor may be implemented with an oxide NMOS transistor. Further, in each pixel PX, a voltage for initializing a capacitor and a voltage for initializing an OLED may be different from each other, and a gate-source voltage having a low absolute value may be applied to a driving transistor. Accordingly, a gradual increase of luminance at the low frequency driving may be prevented.

The data driver 530 may provide data voltages VDAT to the plurality of pixels PX based on a data control signal DCTRL and output image data ODAT received from the controller 590. In some example embodiments, the data control signal DCTRL may include, but is not limited to, an output data enable signal, a horizontal start signal, and a load signal. In some example embodiments, the data driver 530 and the controller 590 may be implemented with a single integrated circuit (IC), and the single integrated circuit may be referred to as a timing controller embedded data driver (TED). In other example embodiments, the data driver 530 and the controller 590 may be implemented with separate integrated circuits.

The scan driver 550 may sequentially provide a plurality of first initialization signals GI_P, a plurality of second initialization signals GI_N, a plurality of first writing signals GW_P, a plurality of second writing signals GW_N, and/or a plurality of scan signals SS to the plurality of pixels PX on a row-by-row basis based on a scan control signal SCTRL received from the controller 590. In some example embodiments, the scan control signal SCTRL may include, but is not limited to, a scan start signal and a scan clock signal. In some example embodiments, the plurality of first initialization signals GI_P, the plurality of first writing signals GW_P, and the plurality of scan signals SS may be signals suitable for PMOS transistors, and may be active low signals having a low level as an active level. The plurality of second initialization signals GI_N and the plurality of second writing signals GW_N may be signals suitable for NMOS transistors, and may be active high signals having a high level as the active level. In some example embodiments, the first initialization signal GI_P for a current pixel row may correspond to the first writing signal GW_P for a previous pixel row, and the second initialization signal GI_N for the current pixel row may correspond to the second writing signal GW_N for the previous pixel row. Further, in some example embodiments, the scan signal SS for the current pixel row may be, but is not limited to, the first writing signal GW_P for a next pixel row. In some example embodiments, the scan driver 550 may be integrated or formed in a peripheral portion of the display panel 510. In other example embodiments, the scan driver 550 may be implemented with one or more integrated circuits.

The emission driver 570 may provide emission signals EM to the plurality of pixels PX based on an emission control signal EMCTRL received from the controller 590. In some example embodiments, the emission signals EM may be sequentially provided to the plurality of pixels PX on a row-by-row basis. In other example embodiments, the emission signals EM may be a global signal that is substantially simultaneously provided to the plurality of pixels PX. In some example embodiments, the emission driver 570 may be integrated or formed in a peripheral portion of the display panel 510. For example, the emission driver 570 may be provided in an opposite peripheral portion from the scan driver 550. In other example embodiments, the emission driver 570 may be implemented with one or more integrated circuits.

The controller 590 (e.g., a timing controller (TCON)) may receive input image data IDAT and a control signal CTRL from an external host processor (e.g., a graphic processing unit (GPU) or a graphic card). In some example embodiments, the control signal CTRL may include, but is not limited to, a vertical synchronization signal, a horizontal synchronization signal, an input data enable signal, a master clock signal, etc. The controller 590 may generate the output image data ODAT, the data control signal DCTRL, the scan control signal SCTRL, and the emission control signal EMCTRL based on the input image data IDAT and the control signal CTRL. The controller 590 may control an operation of the data driver 530 by providing the output image data ODAT and the data control signal DCTRL to the data driver 530, may control an operation of the scan driver 550 by providing the scan control signal SCTRL to the scan driver 550, and may control an operation of the emission driver 570 by providing the emission control signal EMCTRL to the emission driver 570.

In some example embodiments, the controller 590 may determine whether the input image data IDAT represents a still image, and may perform low frequency driving that drives the display panel 510 at a low frequency lower than a normal frequency (e.g., an input frame frequency of the input image data IDAT) based on the input image data IDAT representing the still image. When performing the low frequency driving, the controller 590 may provide the output image data ODAT to the data driver 530 at the low frequency. Accordingly, at the low frequency driving, the data driver 530 may provide the data voltages VDAT to the display panel 510 at the low frequency, and thus power consumption of the OLED display device 500 may be reduced. Further, in some example embodiments, at the low frequency driving, the controller 590 may control the emission driver 570 to provide the emission signals EM at the normal frequency, and may control the scan driver 550 to provide the first initialization signals GI_P, the second initialization signals GI_N, the first writing signals GW_P, and the second writing signals GW_N at the low frequency and to provide the scan signals SS at the normal frequency.

In other example embodiments, the controller 590 may receive a mode signal expressly indicating the low frequency driving from the host processor, and may perform the low frequency driving in response to the mode signal. In this case, not only the output image data ODAT output from the controller 590, but also the input image data IDAT provided from the host processor may be provided at the low frequency suitable for the low frequency driving. Thus, at the low frequency driving, the input frame frequency of the input image data IDAT may be changed from the normal frequency to the low frequency.

Figure 18:
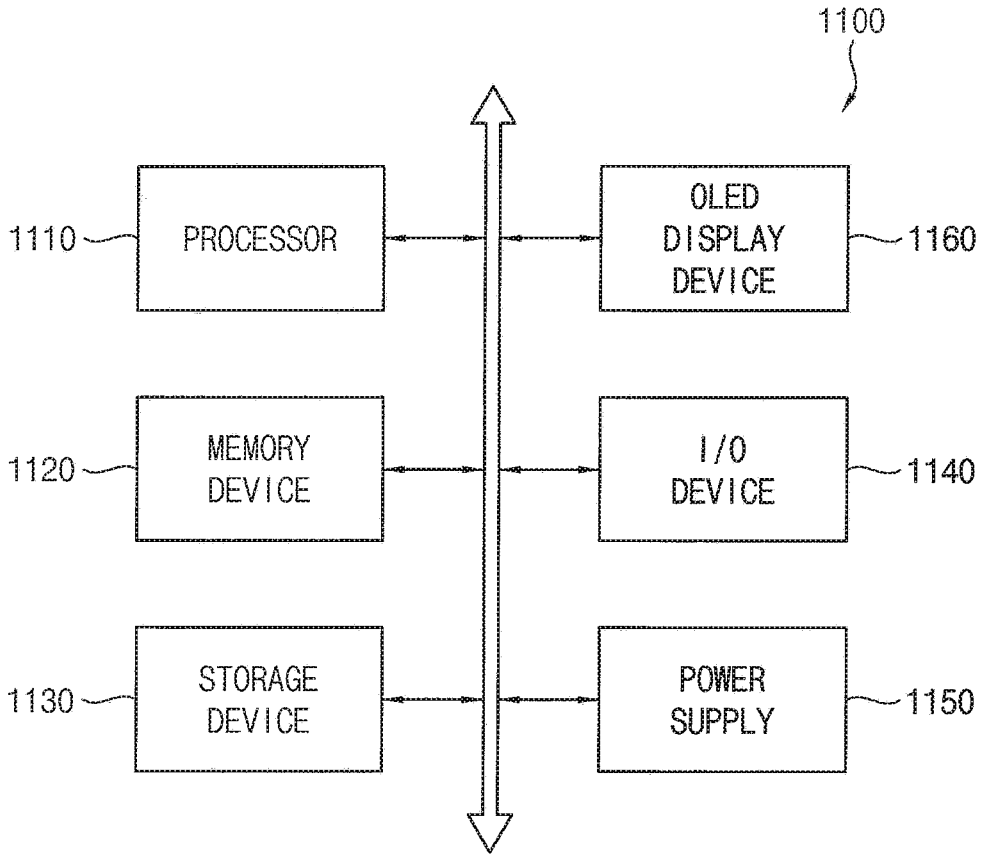
FIG. 18 is an electronic device including an OLED display device according to an example embodiment.

FIG. 18 is an electronic device including an OLED display device according to an example embodiment.

Referring to FIG. 18, an electronic device 1100 may include a processor 1110, a memory device 1120, a storage device 1130, an input/output (I/O) device 1140, a power supply 1150, and an OLED display device 1160. The electronic device 1100 may further include a plurality of ports for communicating with a video card, a sound card, a memory card, a universal serial bus (USB) device, other electric components and/or devices, etc.

The processor 1110 may perform various computing tasks. The processor 1110 may be an application processor (AP), a microprocessor, a central processing unit (CPU), etc. The processor 1110 may be coupled to other components of the electronic device 1100 via an address bus, a control bus, a data bus, etc. Further, in some example embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile DRAM device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc., and an output device such as a printer, a speaker, etc. The power supply 1150 may supply power for operations of the electronic device 1100. The OLED display device 1160 may be coupled to other components of the electronic device 1100 through the buses and/or various communication links.

Each pixel of the OLED display device 1160 may be a HOP pixel suitable for low frequency driving and capable of reducing power consumption. Further, in each pixel of the OLED display device 1160, a voltage for initializing a capacitor and a voltage for initializing an OLED may be different from each other, and a gate-source voltage having a low absolute value may be applied to a driving transistor when the capacitor is initialized. Accordingly, a gradual increase of luminance at the low frequency driving may be prevented.

The inventive concepts of the present disclosure may be applied to any OLED display device 1160, and any electronic device 1100 including the OLED display device 1160. Examples of the electronic device 1100 may include, but are not limited to, a mobile phone, a smart phone, a wearable electronic device, a tablet computer, a television (TV), a digital TV, a three-dimensional (3D) TV, a personal computer (PC), a home appliance, a laptop computer, a personal digital assistant (PDA), a portable multimedia player (PMP), a digital camera, a music player, a portable game console, and a navigation device.

The foregoing is illustrative of example embodiments of the present inventive concept and is not to be construed as limiting thereof. Although some example embodiments have been described, those skilled in the art will readily appreciate that modifications and deviations are possible in the example embodiments without materially departing from the novel teachings and advantages of the present inventive concept. Accordingly, such modifications and deviations are intended to be included within the scope of the present inventive concept as defined in the claims. Therefore, it is to be understood that the foregoing is illustrative of example embodiments and is not to be construed as limited to the specific example embodiments disclosed herein, and that modifications and deviations to the disclosed example embodiments, as well as other example embodiments, are intended to be included within the scope of the appended claims.

What is claimed is:

1. A pixel of an organic light emitting diode (OLED) display device, the pixel comprising:

a capacitor including a first electrode directly connected to a first node, and a second electrode directly connected to a second node;

a first transistor including a gate receiving a first initialization signal, a first terminal receiving a first power supply voltage, and a second terminal directly connected to the first node;

a second transistor including a gate receiving a second initialization signal, a first terminal receiving the first power supply voltage, and a second terminal directly connected to the second node;

a third transistor including a first terminal directly connected to a data line and a second terminal directly connected to the first node;

a fourth transistor including a gate directly connected to the second node, a first terminal receiving the first power supply voltage, and a second terminal directly connected to a third node;

a fifth transistor including a first terminal directly connected to the third node and a second terminal directly connected to the second node;

a sixth transistor including a gate receiving a scan signal, a first terminal receiving an initialization voltage, and a second terminal directly connected to a fourth node;

a seventh transistor including a gate receiving the scan signal, a first terminal receiving the initialization voltage, and a second terminal directly connected to the first node;

an eighth transistor including a gate receiving an emission signal, a first terminal receiving a reference voltage, and a second terminal directly connected to the first node;

a ninth transistor including a first terminal directly connected to the third node and a second terminal directly connected to the fourth node; and an OLED including an anode directly connected to the fourth node, and a cathode receiving a second power supply voltage.

2. The pixel of claim 1, wherein the pixel includes at least one P-type metal-oxide-semiconductor (PMOS) transistor and at least one N-type metal-oxide-semiconductor (NMOS) transistor.

3. The pixel of claim 2, wherein the first, third, fourth, sixth, seventh, eighth, and ninth transistors are PMOS transistors, and wherein the second and fifth transistors are NMOS transistors.

4. Pixel of claim 1, wherein the OLED display device is operable to perform normal frequency driving by-driving the pixel at an input frame frequency of input image data provided to the OLED display device, and each frame period of the OLED display device at the normal frequency driving-includes:

an initialization period in which the capacitor is initialized;

a threshold voltage compensation period in which a data voltage is provided to the first electrode of the capacitor through the data line, and a threshold voltage of the fourth transistor is compensated;

a bias period in which a bias voltage is applied to the fourth transistor, and the OLED is initialized; and an emission period in which the OLED emits light.

5. The pixel of claim 4, wherein, in the initialization period, the first transistor applies the first power supply voltage to the first node in response to the first initialization signal having a first level, and the second transistor applies the first power supply voltage to the second node in response to the second initialization signal having a second level that has an opposite polarity of the first initialization signal.

6. The pixel of claim 5, wherein, in the initialization period, the capacitor is initialized based on the first power supply voltage at the first node and the second node, and the first power supply voltage is applied to the first terminal of the fourth transistor and the gate of the fourth transistor.

7. The pixel of claim 4, wherein, in the threshold voltage compensation period, the third transistor applies the data voltage provided through the data line to the first node in response to a first writing signal having a first level that is applied to a gate of the third transistor, and the fifth transistor diode-connects the fourth transistor in response to a second writing signal having a second level that is applied to a gate of the fifth transistor, and wherein the second writing signal has an opposite polarity of the first writing signal.

8. The pixel of claim 7, wherein, in the threshold voltage compensation period, the data voltage is stored at the first electrode of the capacitor, and the first power supply voltage subtracted with the threshold voltage of the fourth transistor is stored at the second electrode of the capacitor.

9. The pixel of claim 4, wherein, in the bias period, the sixth transistor applies the initialization voltage to the fourth node in response to the scan signal having a first level, and the seventh transistor applies the initialization voltage to the first node in response to the scan signal having the first level.

10. The pixel of claim 9, wherein, in the bias period, the OLED is initialized based on the initialization voltage at the fourth node, a voltage of the first electrode of the capacitor is changed from the data voltage to the initialization voltage, and a voltage of the second electrode of the capacitor is changed, by coupling with the first electrode of the capacitor, to the first power supply voltage minus the threshold voltage of the fourth transistor plus the initialization voltage minus the data voltage.

11. The pixel of claim 4, wherein, in the emission period, the eighth transistor applies the reference voltage to the first node in response to the emission signal having a first level, the fourth transistor generates a driving current based on a voltage of the second electrode of the capacitor, the ninth transistor couples the third node to the fourth node in response to the emission signal having the first level that is applied to a gate of the ninth transistor, and the OLED emits light based on the driving current.

12. The pixel of claim 11, wherein, in the emission period, a voltage of the first electrode of the capacitor is changed from the initialization voltage to the reference voltage, and the voltage of the second electrode of the capacitor is changed, by coupling with the first electrode of the capacitor, to the first power supply voltage minus the threshold voltage of the fourth transistor minus the data voltage plus the reference voltage.

13. The pixel of claim 1, wherein the OLED display device is operable to perform low frequency driving by-driving the pixel at a low frequency that is lower than an input frame frequency of input image data provided to the OLED display device, and at least one of a plurality of frame periods of the OLED display device at the low frequency driving includes:

an initialization period in which the capacitor is initialized;

a threshold voltage compensation period in which a data voltage is provided to the first electrode of the capacitor through the data line, and a threshold voltage of the fourth transistor is compensated;

a bias period in which a bias voltage is applied to the fourth transistor and the OLED is initialized; and an emission period in which the OLED emits light, and wherein each of remaining frame periods of the plurality of frame periods includes only the bias period and the emission period.

14. The pixel of claim 13, wherein, while the OLED display device performs the low frequency driving, the first initialization signal and the second initialization signal, are provided to the pixel at the low frequency of the low frequency driving, and the scan signal and the emission signal are provided to the pixel at the input frame frequency.

15. The pixel of claim 1, wherein the second transistor further includes a first bottom electrode under the gate of the second transistor, and wherein the fifth transistor further includes a second bottom electrode under the gate of the fifth transistor.

16. The pixel of claim 15, wherein the first bottom electrode of the second transistor receives the second initialization signal, and wherein the second bottom electrode of the fifth transistor receives a second writing signal that is applied to a gate of the fifth transistor.

17. The pixel of claim 15, wherein the first bottom electrode of the second transistor is coupled to the first terminal of the second transistor, and wherein the second bottom electrode of the fifth transistor is coupled to the second terminal of the fifth transistor.

18. A pixel of an organic light emitting diode (OLED) display device, the pixel comprising:

a capacitor including a first electrode directly connected to a first node, and a second electrode directly connected to a second node;

a first transistor including a gate receiving a first initialization signal, a first terminal directly connected to a line of a first power supply voltage, and a second terminal directly connected to the first node;

a second transistor including a gate receiving a second initialization signal, a first terminal directly connected to the line of the first power supply voltage, and a second terminal directly connected to the second node;

a driving transistor including a gate directly connected to the second node;

an emission transistor including a gate receiving an emission signal; and an OLED directly connected to the emission transistor and including a cathode receiving a second power supply voltage.

19. The pixel of claim 18, wherein the OLED display device is operable to perform low frequency driving by driving the pixel at a low frequency that is lower than an input frame frequency of input image data provided to the OLED display device, and at least one of a plurality of frame periods of the OLED display device at the low frequency driving includes:

an initialization period in which the capacitor is initialized;

a threshold voltage compensation period in which a data voltage is provided to the first electrode of the capacitor through a data line, a threshold voltage of the driving transistor is compensated, and the OLED is initialized; and an emission period in which the OLED emits light in response to the emission signal, and wherein each of remaining frame periods of the plurality of frame periods includes only the emission period.

20. An organic light emitting diode (OLED) display device comprising a plurality of pixels, each of the plurality of pixels comprising:

a capacitor including a first electrode directly connected to a first node, and a second electrode directly connected to a second node;

a first transistor including a gate receiving a first initialization signal, a first terminal directly connected to a line of a first power supply voltage, and a second terminal directly connected to the first node;

a second transistor including a gate receiving a second initialization signal, a first terminal directly connected to the line of the first power supply voltage, and a second terminal directly connected to the second node;

a driving transistor including a gate directly connected to the second node;

an emission transistor including a gate receiving an emission signal; and an OLED directly connected to the emission transistor and including a cathode receiving a second power supply voltage.

* * * * *